US007534159B2

(12) United States Patent
Nomura et al.

(10) Patent No.: US 7,534,159 B2
(45) Date of Patent: May 19, 2009

(54) PROCESSING METHOD AND APPARATUS

(75) Inventors: Michinao Nomura, Kawasaki (JP); Yoshiaki Yanagida, Kawasaki (JP); Koji Sudo, Kawasaki (JP); Shunsuke Sone, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 724 days.

(21) Appl. No.: 11/094,659

(22) Filed: Mar. 31, 2005

(65) Prior Publication Data

US 2005/0186887 A1 Aug. 25, 2005

Related U.S. Application Data

(63) Continuation of application No. PCT/JP03/07970, filed on Jun. 23, 2003.

(51) Int. Cl.
*B24B 49/00* (2006.01)

(52) U.S. Cl. ..... 451/5; 451/11; 451/55

(58) Field of Classification Search ..... 451/5, 451/8, 11, 41, 55, 397, 390; 29/603.12, 603.16
See application file for complete search history.

(56) References Cited

U.S. PATENT DOCUMENTS

| | | | | |
|---|---|---|---|---|
| 4,802,309 | A | 2/1989 | Heynacher | |
| 4,850,152 | A | 7/1989 | Heynacher et al. | |
| 4,914,868 | A * | 4/1990 | Church et al. | 451/5 |
| 5,969,865 | A | 10/1999 | Shirasaki | |
| 6,050,878 | A * | 4/2000 | Kanzo et al. | 451/5 |
| 6,315,633 | B1 * | 11/2001 | Kozu et al. | 451/5 |
| 6,447,367 | B1 | 9/2002 | Kozu et al. | |
| 6,623,336 | B2 * | 9/2003 | Shindou et al. | 451/41 |
| 6,709,321 | B2 * | 3/2004 | Ishizaki et al. | 451/364 |

FOREIGN PATENT DOCUMENTS

| | | |
|---|---|---|
| JP | 63-162150 | 7/1988 |
| JP | 64-11744 | 1/1989 |
| JP | 07-130686 | 5/1995 |
| JP | 10-118917 | 5/1998 |
| JP | 10-286771 | 10/1998 |
| JP | 11-070452 | 3/1999 |
| JP | 11-104958 | 4/1999 |
| JP | 11-333716 | 12/1999 |
| JP | 2000-6003 | 1/2000 |
| JP | 2000-084818 | 3/2000 |
| JP | 2001-179616 | 7/2001 |
| JP | 2001-341064 | 12/2001 |
| JP | 2002-046059 | 2/2002 |

(Continued)

OTHER PUBLICATIONS

"Special Issue: Optical Devices Applicable for a Dense Wavelength Division Multiplexing (DWDM) System, VIPA-Type Dispersion Compensator for 40 Gbps WDM System," pp. 67-69.

(Continued)

*Primary Examiner*—Dung Van Nguyen
(74) *Attorney, Agent, or Firm*—Staas & Halsey LLP

(57) ABSTRACT

A processing method includes the steps of elastically deforming a jig together with a work, the jig having been mounted on a work, compressing the work against a polishing surface, and moving the work and the polishing surface relative to each other.

6 Claims, 25 Drawing Sheets

FOREIGN PATENT DOCUMENTS

| | | |
|---|---|---|
| JP | 2002-113646 | 4/2002 |
| JP | 2002-514323 | 5/2002 |
| JP | 2002-252192 | 9/2002 |
| JP | 2002-301659 | 10/2002 |
| JP | 2003-025201 | 1/2003 |

OTHER PUBLICATIONS

International Search Report dated Jul. 22, 2003 of PCT/JP03/04083.
International Search Report dated Oct. 7, 2003 of PCT/JP03/07970.

* cited by examiner

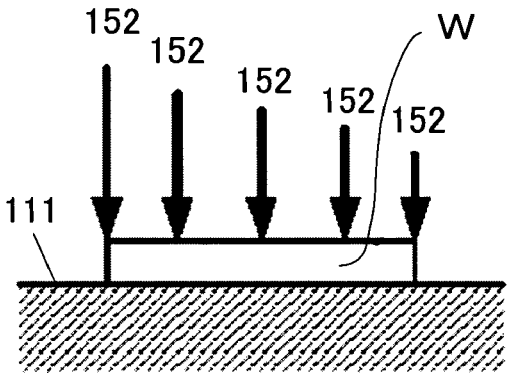
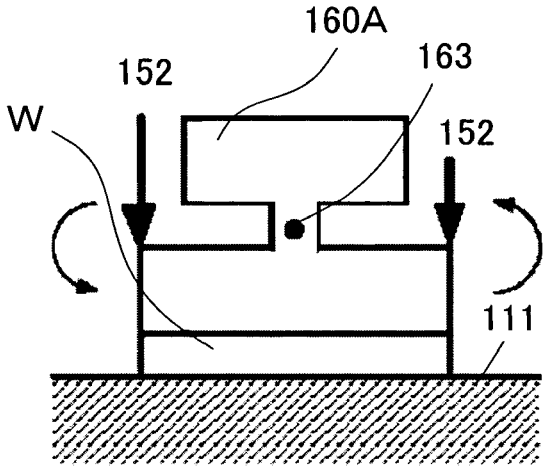
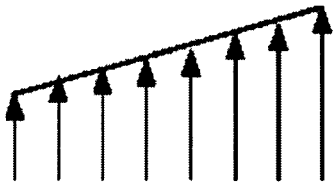
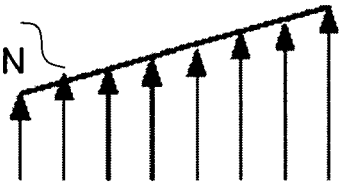
FIG. 6A
FIG. 6B

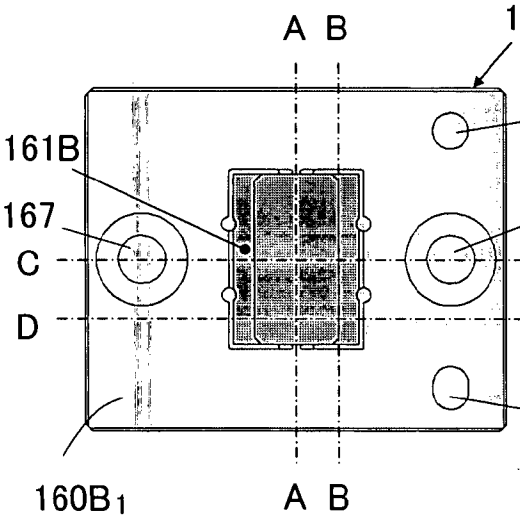
FIG. 7A
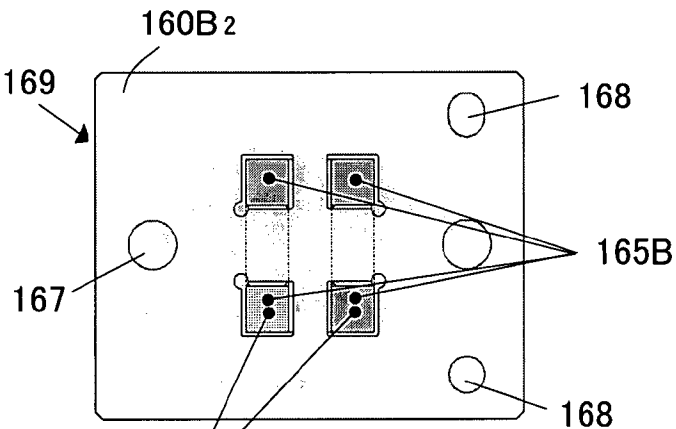
FIG. 7B
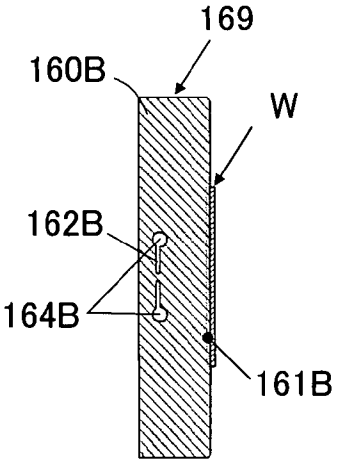
FIG. 7C
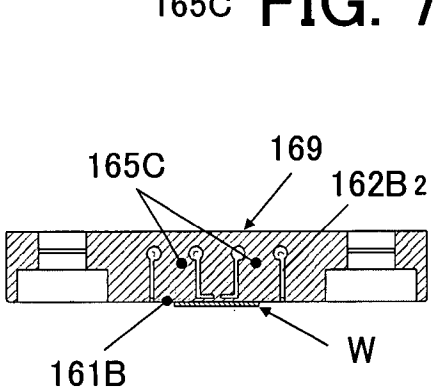
FIG. 7D
FIG. 7E
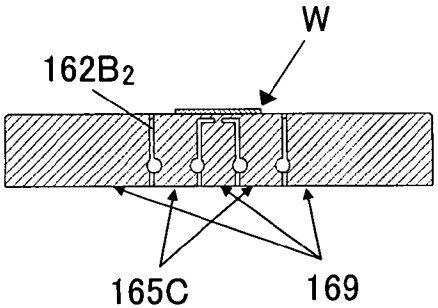
FIG. 7F

PROCESSING METHOD AND APPARATUS

This application is a continuing application, filed under 35 U.S.C. §111(a), of International Application PCT/JP03/07970, filed Jun. 23, 2003, it being further noted that priority is based upon International Application PCT/JP03/04083, filed Mar. 31, 2003, which is hereby incorporated by reference herein in its entirety as if fully set forth herein.

BACKGROUND OF THE INVENTION

The present invention relates generally to a three-dimension curved shape forming method and apparatus, and more particularly to a polishing method and apparatus. The present invention is suitable, for example, for a curved shape formation and surface processing for an optical element that are required to have a high surface precision on its surface, such as freely curved mirrors and lenses.

Optical elements for use with optical communications, such as a mirror and a lens, are required to have a higher surface precision with the recent high speed and large capacity communications. In particular, a mirror used for a variable optical dispersion compensator in the Dense Wavelength Division Multiplexing ("DWDM") has such a small area as 10 mm×several millimeters and a complicated free-form surface shape, and needs a very high surface precision. Several variable optical dispersion compensators have already been proposed for the DWDM (see, for example, International Application Domestic Publication No. 2002-514323 and Yuichi Kawabata, Noriaki Mitamura, and Hideki Isono, "VIPA dispersion compensator for 40 Gbps WDM system", Electronic Material, Kogyo Chosakai Publishing Inc., Nov. 1, 2001, Vol. 40, No. 11, pp 67-69.

In order to manufacture an optical element having such a complicated free-form surface shape, the prior art uses a three-dimensional processing unit having five or six degrees of freedom to manufacture a mold for the optical element, then a molding compound, such as resin and glass, is molded into a mirror shape, and finally a mirror surface is generated by evaporating aluminum or gold onto a necessary surface. As a method that forms a target surface shape on an optical element, such as a lens and a rod mirror, Japanese Patent Application, Publication No. 2000-84818 discloses a method that pressurizes plural actuators (pressurizers) for polishing. Other prior art includes, for example, Japanese Patent Application, Publication No. 10-118917.

However, a method that uses the three-dimensional processing unit and resin molding transfers a trace of tool on a mold's free-form surface part, onto a free-form surface part on a resin molded article, and lowers the surface precision. On the other hand, a hand lap (i.e., a fine polishing method that is performed by an operator's hands) is one measure to remove the trace of tool in advance. Nevertheless, the hand lap destroys a shape optimized in the processing unit, and cannot reconcile the form accuracy with the surface precision.

A method disclosed in Japanese Patent Application, Publication No. 2000-84818 forms a shape during polishing and does not generate problems associated with the three-dimensional processing unit. Originally, the load applying approach by an external mechanism during polishing is usually used for a wafer flattening process in the chemical mechanical polishing ("CMP"), and the methodology is common in that both control a polishing amount distribution on a work's polished surface using an external mechanism, although they have different objects, such as shaping and flattening. The conventional load applying method including the flattening polishing process can be classified into two types—a method (shown in FIG. 12) that provides a processing head that holds a work with fine holes in its work holding surface, connects these holes with an air supply source, and applies the load to the work through the air pressure control; and a method (shown in FIG. 13) that provides a processing head with plural actuators, such as an air cylinder and piezoelectric element, and directly applies the load to the work's back surface.

The fundamental concept of these methods is to apply the load through an external mechanism (such as the above air pressurizer and actuator) to a location at which the polishing amount is to increase and to locally improve the contact pressure and polishing speed. Nevertheless, these methods can control the pressure only around the air supply hole in the method shown in FIG. 12 and around the actuator's contact pressure point in the method shown in FIG. 13. In other words, these methods apply the high point load only near the application point of the load, and cannot control the load at other positions where there is no mechanism. Therefore, the high form accuracy requires many application points. For a relatively large work, such as a wafer, a predetermined number of application points (for example, several tens of application points or air supply holes are enough for the processing head in the method shown in FIG. 12) may be provided. However, only several points can be provided for a small work such as an optical element, for example, having 10 mm square or smaller. Another problem is that the method that provides application points directly on the work's back surface and controls the contact pressure against the work by plural point loads causes an excessive high pressure difference between the vicinity of the application point where the contact pressure is locally high and the other positions, and results in irregularities corresponding to the application points on the resultant polished surface. In addition, when the work has a thickness of 1 mm or smaller, the work itself may possibly get damaged.

BRIEF SUMMARY OF THE INVENTION

Accordingly, with the foregoing in mind, it is an exemplary object of the present invention to provide a processing method and apparatus that can form a complicate shape on a work with high precision.

In order to achieve the above object, a processing method according to one aspect of the present invention includes the steps of elastically deforming a jig together with a work, the jig having been mounted on a work, compressing the work against a polishing surface, and moving the work and the polishing surface relative to each other. Instead of relying only upon local changes of the pressure used to compress the work against the polishing surface, this processing method elastically deforms the jig together with the work by applying the load to predetermined positions on the jig. Instead of directly providing application points on the work, a large jig having application points may maintain a desired number of application points for a small work. In addition, a thin work is prevented from getting damaged since the work receives no direct compression force. Moreover, particularly when the application points are provided to the jig instead of directly providing the work with application points, an application of the tensile load becomes easy without damaging the work. The jig elastically deforms with the work instead of controlling the work's contact pressure only by plural point loads, and maintains the uniformity of the contact pressure distribution.

The elastically deforming step may include the step of controlling a load applied to the jig at a predetermined position for an elastic deformation, by assuming that there is a linear relationship between the load and a deformation amount of the work associated with the load and/or by approximating with an arc a deformation amount of the work associated with the load. These approximations can simplify the control, and lessen the burden of the control software. The load controlling step includes, for example, the steps of calculating a necessary polishing amount distribution based on a difference between a current shape of the work and a target shape of the work, calculating positional information of the work and a relative speed distribution between the work and the polishing surface, and calculating the load based on the polishing amount distribution and the relative speed distribution.

Preferably, the elastically deforming step deforms the jig in stages. In particular, if a large load is applied to the jig suddenly, deforms the jig, and the work contacts the polishing surface, a polished surface would damage the polishing surface when the polished surface is a curved surface.

The processing method may further include the steps of changing a particle diameter of the slurry introduced into the polishing surface, and changing a cutting tool radius or angle as a facing condition. For example, the slurry's particle diameter may be different between the normal polishing time and the finishing process time. More specifically, the finishing process may use a smaller slurry particle diameter.

The moving step may rotate the work, offset a center of the work from the center of the rotation, change the decentering amount, and swing the work. Thereby, the work has a precisely polished surface.

The processing method may further include the steps of measuring a position or angle displacement of a member that holds the work, and controlling the processing amount of the work using the measurement result. The control over the polishing amount may process the work into the desired shape. The compression step may change the compression force by which the work is compressed against the polishing surface, in accordance with the processing amount. The processing method may further include the step of correcting the shape of the work using the laser. Thereby, the fine correction to the shape of the work is locally available. The processing method may process the work into a desired shape, even when the work's thickness is 3 mm or smaller.

A processing apparatus according to another aspect of the present invention that polishes a work into a predetermined shape by compressing the work against a polishing surface, and by moving the work and the polishing surface relative to each other, said processing apparatus comprising an actuator that applies a load to a predetermined position of a jig that has been mounted on a work, and elastically deforms the jig together with the work. Instead of the actuator that locally changes the pressure used to compress the work against the polishing surface, this processing apparatus elastically deforms the jig together with the work by applying the load to a predetermined position of the jig, thereby exhibiting the operation similar to the above processing method.

The actuator may include a mechanism that applies a tensile load to the jig, such as a link mechanism. A combination of a compression load and a tensile load facilitates a deformation of the jig into a desired shape. While the conventional method that controls the contact pressure of the work by plural point load has difficulties in applying the tensile force to the work, a combination of the jig and actuator enables both of the compression load and the tensile load to be applied to the work simultaneously, and facilitates the processing of the work into the desired shape.

The processing apparatus may further include a controller that controls a load applied to the jig at a predetermined position for an elastic deformation, by assuming that there is a linear relationship between the load and a deformation amount of the work associated with the load and/or by approximating with an arc a deformation amount of the work associated with the load. These approximations simplify the control, and lessen the burden of the controller. The processing apparatus may further include a measuring part that measures a current shape of the work, wherein the controller may include, for example, a first polishing amount operating unit that calculates a necessary polishing amount distribution based on a difference between a current shape of the work and a target shape of the work, a second operating unit that calculates a relative speed distribution based on positional information of the work and a rotating speed of the polishing speed, a third operating unit that calculates a contact pressure distribution of the work against the polishing surface based on the necessary polishing amount distribution and the relative speed distribution, and a fourth operating unit that calculates the load necessary for the contact pressure distribution.

A jig according to another aspect of the present invention used for a processing apparatus that polishes a work into a predetermined shape by compressing a work against the polishing surface, and by moving the work and the polishing surface relative to each other, includes a guide mechanism that provides an elastic deformation with the work, and a forced member to which the processing apparatus applies a load for an elastic deformation. This jig is used for the above processing apparatus, and can exhibit the operations similar to those of the above processing method and apparatus. The jig is made, for example, of stainless steel or ceramics. The inventive jig is suitable for a thin work that has a thickness of 1 mm or smaller, or a small work having an area equal to or smaller than 500 $mm^2$.

A jig used for a processing apparatus that polishes a work into a predetermined shape by compressing a work against the polishing surface, and by moving the work and the polishing surface relative to each other, includes a mounting part that mounts the work and forms an arbitrarily curved surface, a rotating lever part that rotates around a rotating center when an external load is applied, and elastically deforms the mounting part, and a fixing part that does not deform even when the external load is applied to the rotating lever. This jig elastically deforms with the work when the external load is applied to the jig. Thereby, this jig exhibits a similar operation to that of the above processing method. The fixing part determines a reference position of the deformation by the rotating lever part, and thus a deformation of the mounting part is preferably independent of the fixing part using a slit etc. The work is bonded to the mounting part via the adhesive, and the mounting part preferably has a groove or hole. Thereby, the bonding area increases between the adhesive and the mounting part, improving the bonding strength for the work.

A processing apparatus that polishes a work into a predetermined shape by compressing the work against a polishing surface, and by moving the work and the polishing surface relative to each other, includes an actuator that applies a load to a predetermined position of the above jig that has been mounted on a work, and elastically deforms the jig together with the work. This processing apparatus uses the above jig and exhibits operations of the above jig and processing method.

The processing apparatus may further include a processing head that mounts the jig and has the actuator, a processing base that supports said processing head, and a positioning mechanism for positioning the work on the polishing surface, wherein the positioning mechanism includes plural shafts provided to one of said processing head and said processing base, and a linear bush, provided to the other of said processing head and said processing base, which allows a movement along a longitudinal direction of the shaft. The linear bush restricts the shaft's action other than the longitudinal action, providing the highly precise positioning. In addition, the linear bush allows the longitudinal action of the shaft, and does not hinder the processing to the work. Alternatively, the processing apparatus may further include a processing head that mounts the jig and has the actuator, a processing base that supports said processing head, and a positioning mechanism for positioning the work on the polishing surface, wherein the positioning mechanism includes a pivot provided to one of said processing head and said processing base, and the other of said processing head and said processing base contacts the pivot at one point. The pivot restricts actions other than the rotation around the pivot, providing the highly precise positioning. In addition, the pivot allows the rotation around the pivot, and does not hinder the processing to the work.

The processing apparatus may further include a measuring system that measures a processing amount of the work, wherein said measuring system includes a measuring part that measures a processing amount of an object, which is provided on the processing head, and a reference measuring part that outputs a reference value to be compared with a measurement result measured by the measuring part. A measurement of the processing amount of the work improves the processing precision of the work. The processing apparatus may further include a decentering mechanism to offset a center of the work from the rotating center of the jig in polishing the work. Thereby, the work has a precise polished surface. The processing apparatus may further include a correction ring that supports the processing base on the polishing surface, and integrally rotates with the processing head and processing base on the polishing surface. The correction ring integrated with the processing head and the processing base saves the space.

Other objects and further features of the present invention will become readily apparent from the following description of the preferred embodiments with reference to accompanying drawings.

BRIEF DESCRIPTION OF THE DRAWINGS

FIGS. 6A and 6B are sectional views for explaining an effect of the processing jig shown in FIGS. 4A and 4B.

FIGS. 7A-7F are perspective views of another processing jig mounted with the work and used for the processing apparatus shown in FIG. 1.

DETAILED DESCRIPTION OF THE PREFERRED EMBODIMENTS

Figure 1:
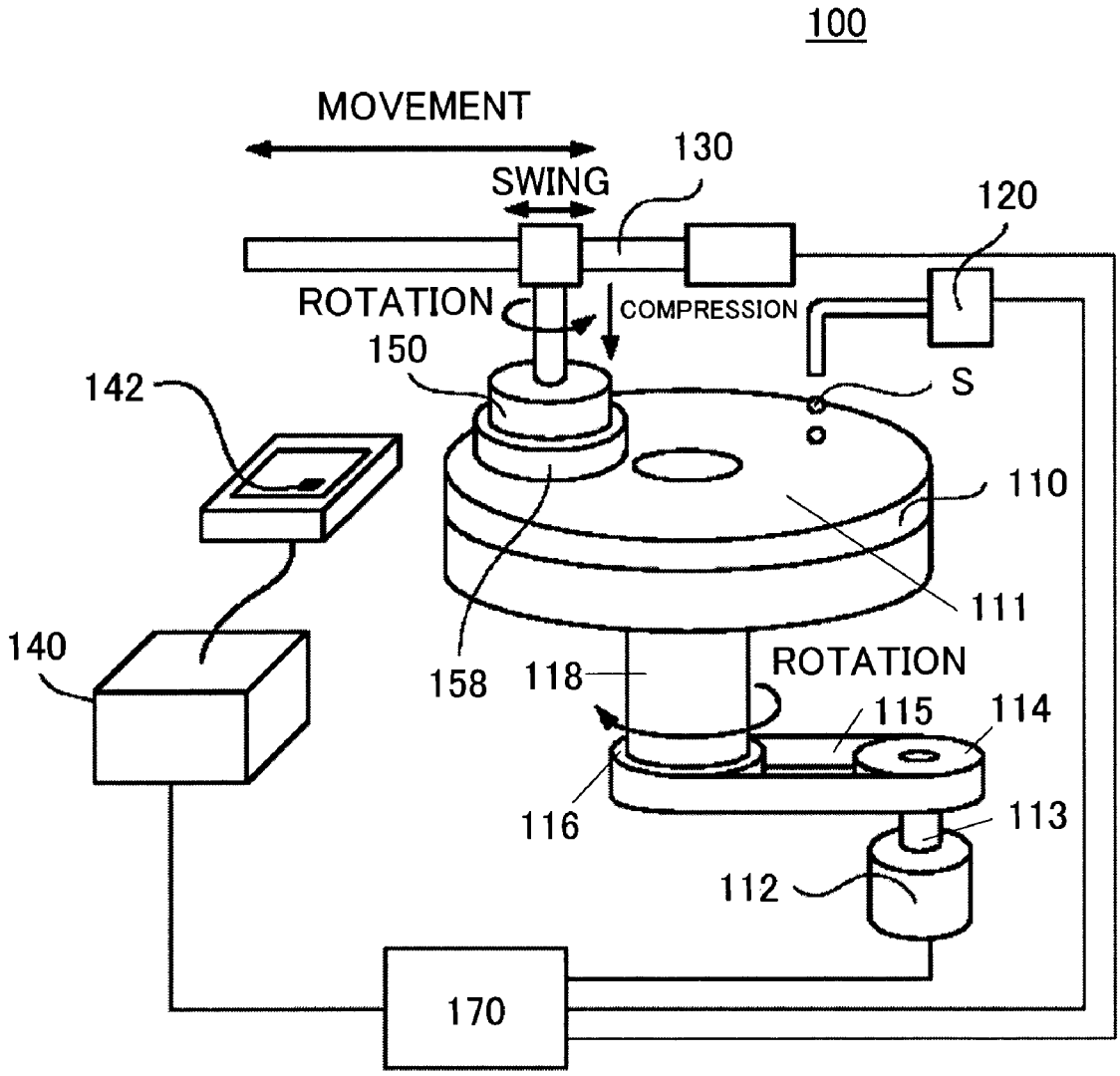
FIG. 1 is a schematic perspective view of a processing apparatus according to one embodiment of the present invention.
Figure 2:
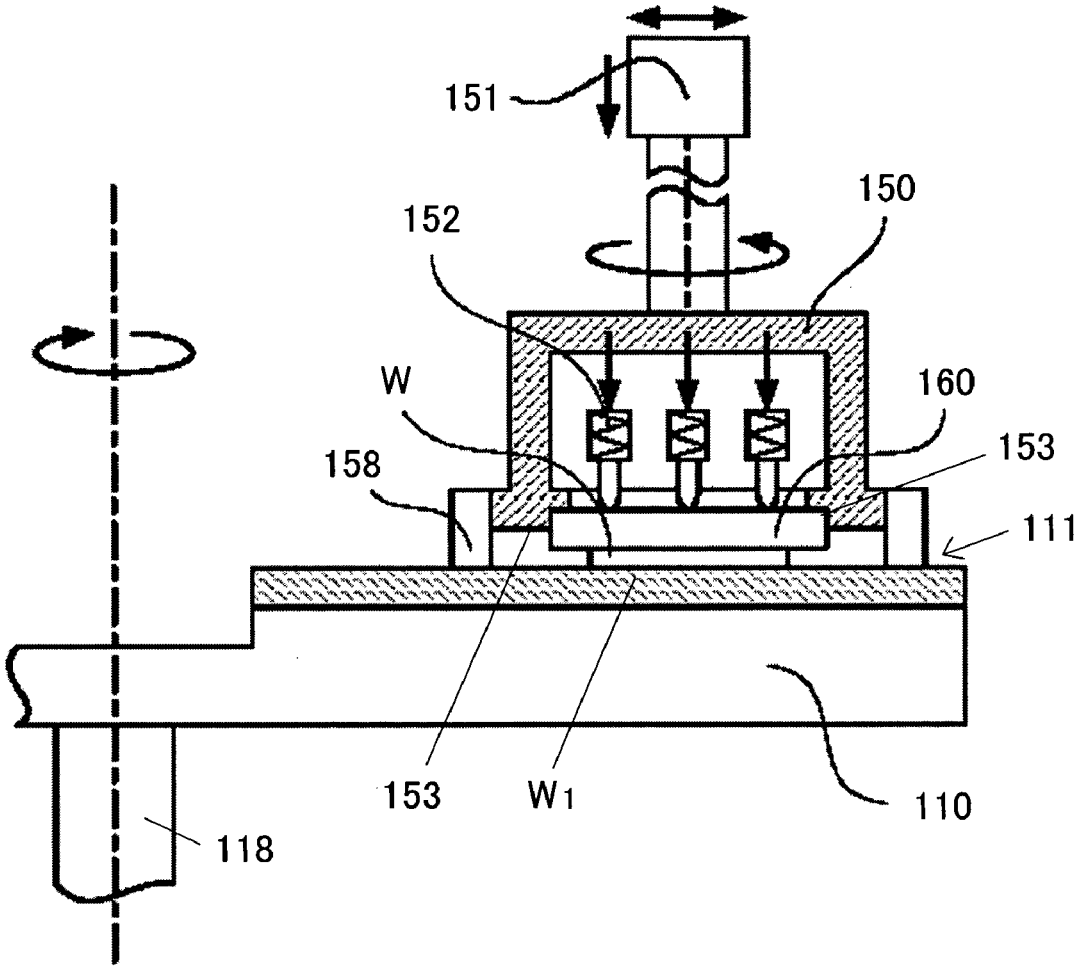
FIG. 2 is a schematic sectional view of a processing head used for the processing apparatus shown in FIG. 1.

A description will now be given of a processing apparatus 100 according to one embodiment of the present invention, with reference to FIGS. 1 and 2. Here, FIG. 1 is a schematic perspective view of the processing apparatus 100. FIG. 2 is a schematic sectional view of a processing head 150 used for the processing apparatus 100.

The processing apparatus 100 provides lapping, which is polishing that introduces abrasive grains called slurry S between a work W supported by a processing head 150 and a polishing tool called a lapping machine 110, and moves the work W relative to the lapping machine 110 while the work's polished surface $W_1$ contacts the lapping machine's polishing surface 111, so that the slurry S between them polishes the polished surface.

The processing apparatus 100 includes five modules, as shown in FIG. 1, i.e., a lapping machine 110, a slurry supply pump 120, a processing arm 130, a shape measuring unit 140, and a processing head 150. Each module is connected to one controller 170. Plural processing arms and heads may be provided. The plurality can improve the productivity.

The lapping machine 110 has a polishing surface 111 that polishes the work W, and is rotated by a motor 112. The connected controller 170 controls starts and stops of the rotations and the rotating speed of the motor 112 in this embodiment. The driving force of the motor 112 is transmitted to a roller 116 fixed onto a rotary shaft 118 of the lapping machine 110 via a belt 115 that is engaged with a roller 114 that is pivotally supported around a motor shaft 113, and rotates the lapping machine 110.

The slurry supply pump 120 always supplies the slurry S to the polishing surface 111 of the lapping machine 110. The pump 120 drops the slurry S onto the lapping machine 110 through a pipe from a storage tank (not shown). This embodiment provides plural storage tanks that store different concentrations of slurries S, and the connected controller 170 designates the supply amount of the slurry S and controls switching of the slurry S to be used.

The processing arm 130 moves the processing head 150 and the work W to a predetermined position on the processing apparatus 100. While FIG. 1 shows a direct acting arm, a scholar type rotation/swing moving mechanism may be used. This embodiment moves them to three predetermined positions by the controller 170 including a process start position, a retreat position and a shape measuring position.

The shape measuring apparatus 140 includes a measuring head 142 that measures a shape of the polished surface $W_1$ of the work W, and is provided near the lapping machine 110 and within a moving range of the processing arm 130. A measuring method of the measuring head 142 preferably uses a laser or ultrasonic that can measure the work W supported the positioning head 150 in a non-contact manner. A wiper mechanism may be provided and removes the waste slurry S that affects the measurement. In this embodiment, the controller 170 designates the start and end of the measurement, and the measured shape data is stored in the storage area (master) (not shown) in the controller 170.

The processing head 150 supports a jig 160 that supports the work W at a holder 153, and is pressed against the lapping machine 110 by its own weight and a pressurizing and swinging mechanism 151. The pressurizing and swinging mechanism 151 compresses the processing head 150 that supports the work W against the polishing surface 111, and enables the work W to be compressed at a predetermined compression force against the polishing surface 111. However, when the weight of the processing head 150 is sufficient, the pressurizing and swinging mechanism 151 may omit its pressurizing mechanism. The swinging mechanism in the pressurizing and swinging mechanism 151 is used to swing the processing head 150. Rotations or swings of the processing head 150 provide a uniform distribution of the slurry S on the work W's polished surface $W_1$, and polish the work W rotationally symmetrically.

While FIG. 1 provides one processing head 150 to one lapping machine 110, the lapping machine 110 may be equipped with plural processing heads 150 for simultaneous processing.

Figure 12:
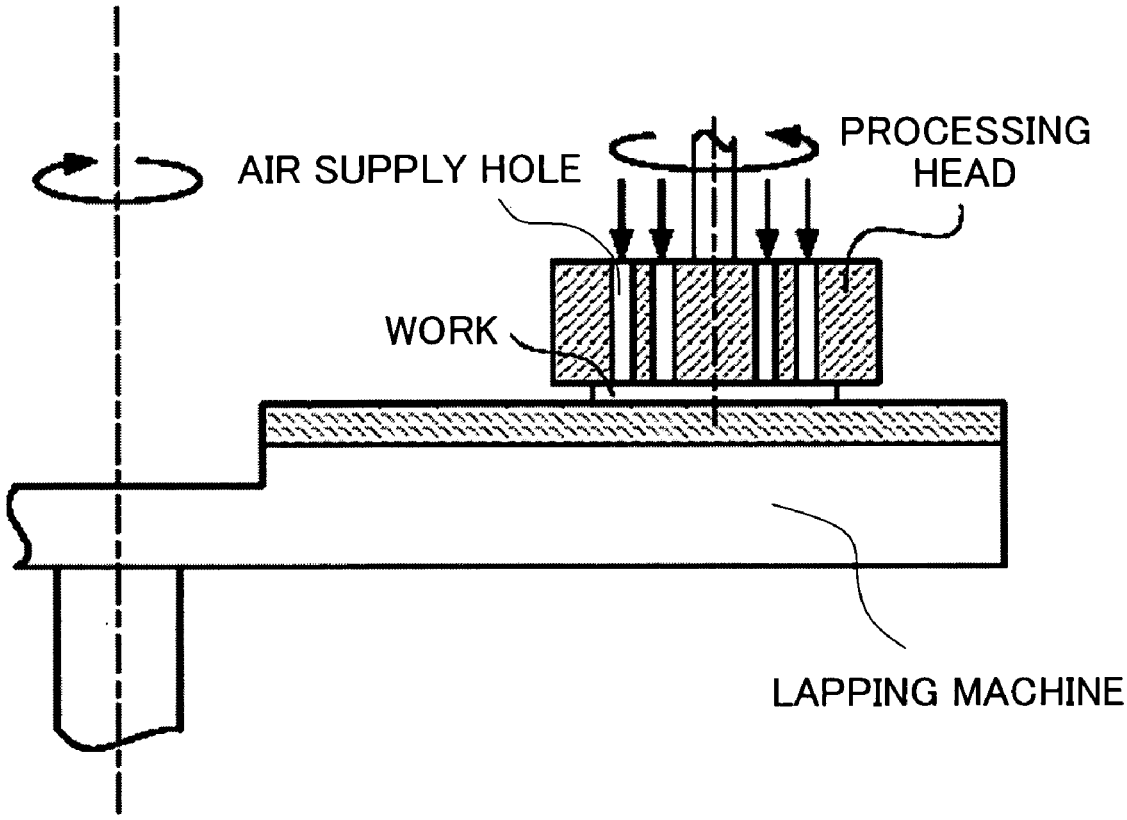
FIG. 12 is a view for explaining a conventional load applying method.
Figure 13:
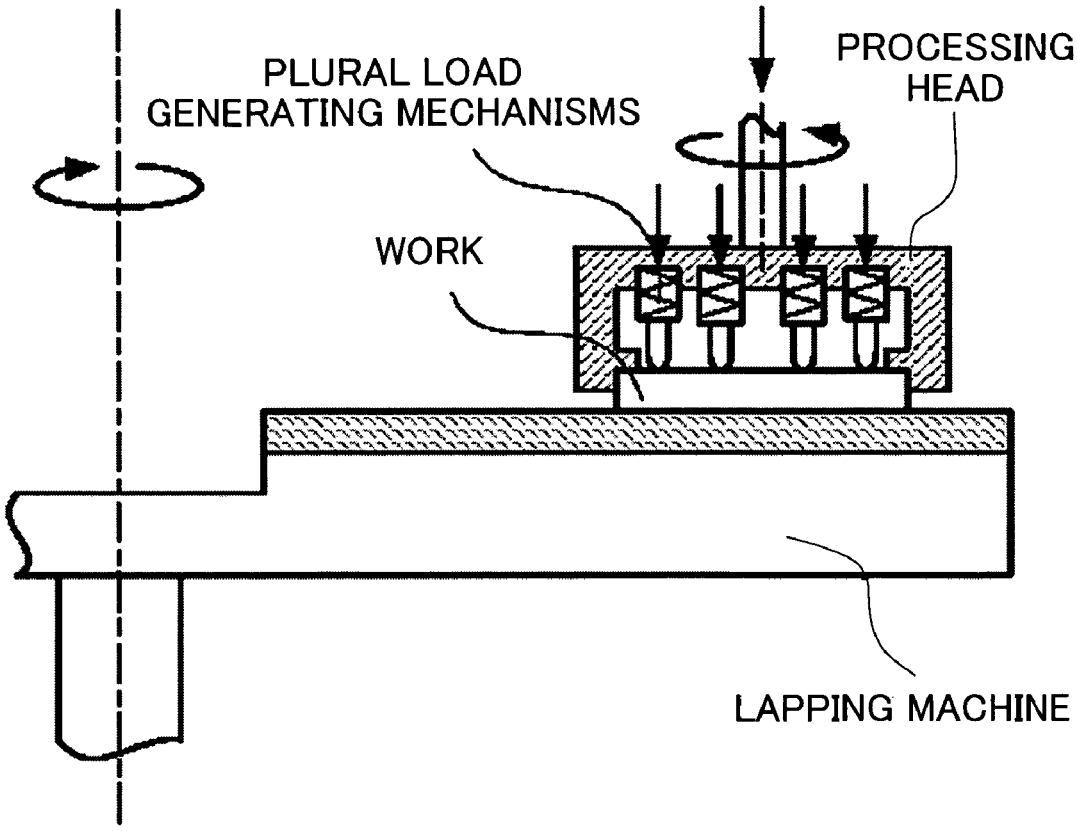
FIG. 13 is a view for explaining a conventional load applying method.

The processing head 150 further includes one or more actuators 152 in addition to the pressurizing and swinging mechanism 151. The actuator 152 serves as a load applying mechanism that applies the load to a predetermined position on the jig 160. The actuator 152 may be the air cylinder shown in FIG. 12 or the piezoelectric element shown in FIG. 13 as long as the controller 170 controls the load generated by the actuator 152. The actuator 152 applies the load to the processing jig 160, and does not apply the load directly onto the work W. Thus, the processing head 150 of this embodiment applies the constant load to the work W entirely and individually applies the load to predetermined positions on the jig that holds the work W. However, as discussed above, the pressure in the present invention may be applied only by the weight of the processing head 150 or the compression force by the pressurizing and swinging mechanism 151.

Figure 8:
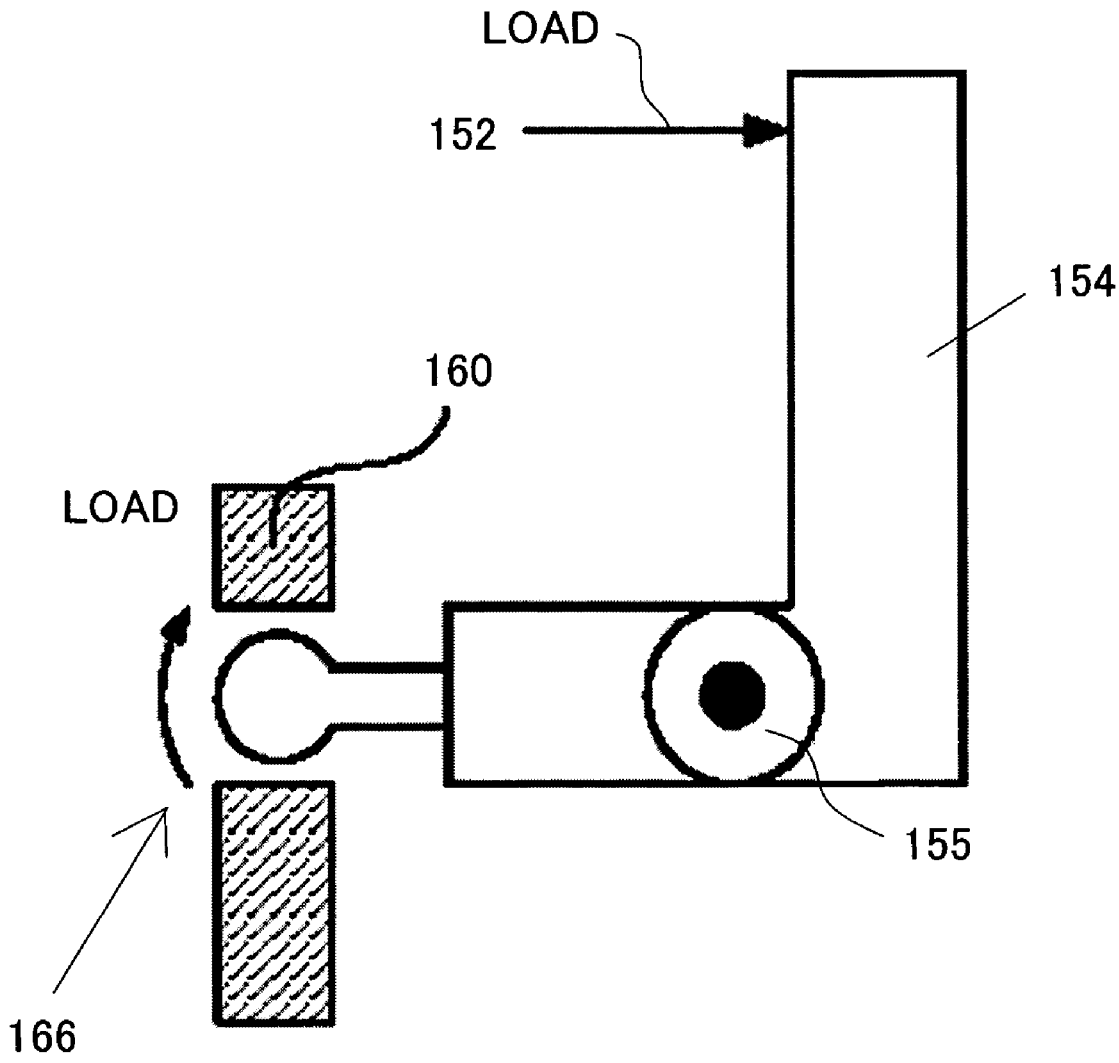
FIG. 8 is a schematic sectional view for explaining a link mechanism used for the processing apparatus shown in FIG. 1, and used to apply the tensile load to the processing jig mounted with the work.

While the actuator 152 shown in FIG. 2 provides a compression load to the processing jig 160, both the compression load and the tensile load are available by using a link mechanism 154 that can rotate around a rotating center 155 and a hole 166 in the jig 160 for a connection between the actuator 152 and the jig 160 as shown in FIG. 8. Here, FIG. 8 is a schematic sectional view for explaining the link mechanism 154 that applies the compression and tensile loads to the processing jig 160 mounted with the work.

As shown in FIG. 2, the processing jig 150 is combined with a correction ring 158 as a jig that corrects the polishing surface 111 on the lapping machine 110. More specifically, the correction ring 158 has a hollow ring shape, and is connected to the bottom periphery of the holder 153 in the processing head 150. The correction ring 158 serves to supply the slurry S to the lapping machine 110. The correction ring 158 has a hole to release the slurry S. However, the correction ring 158 does not have to be combined with the processing head 150 and provided separately and spaced.

Figure 3C:
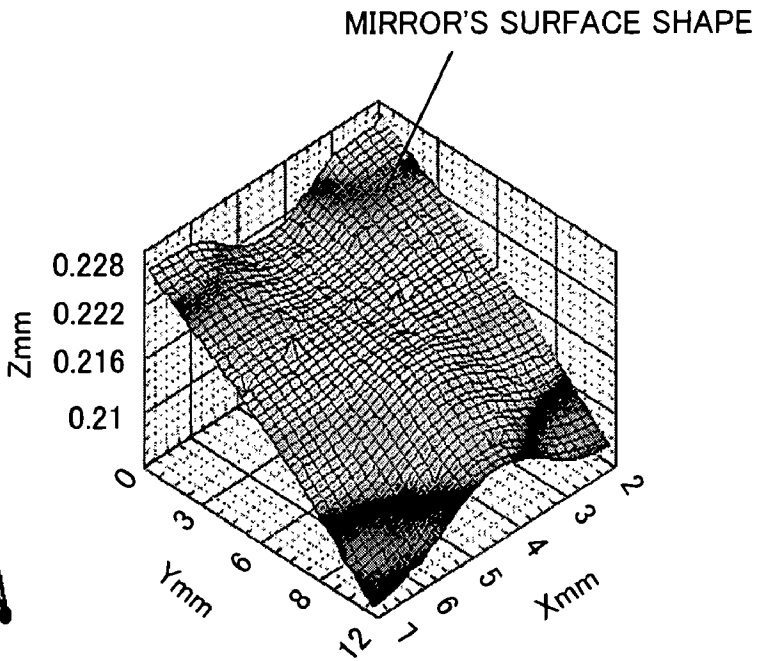
FIGS. 3A to 3C are perspective views showing a target shape of a work to be processed by the processing apparatus shown in FIG. 1.
Figure 3B:
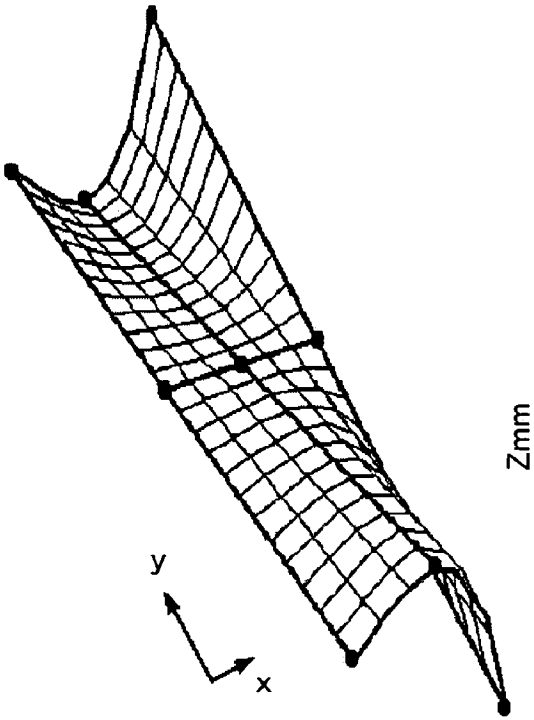
Figure 3A:
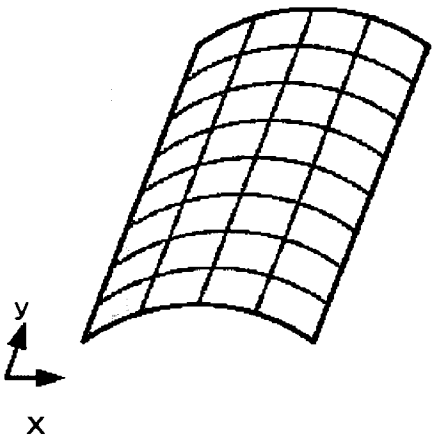
Figure 4A:
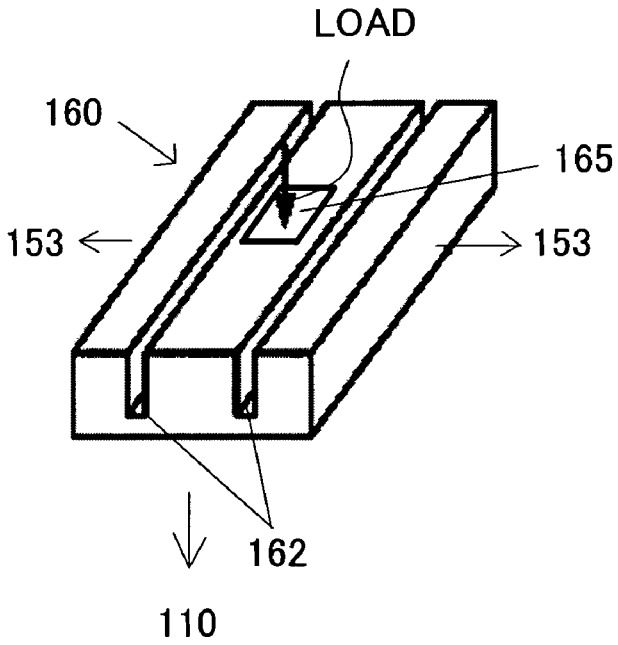
FIGS. 4A and 4B are perspective views of a processing jig mounted with the work and used for the processing apparatus shown in FIG. 1.
Figure 4B:
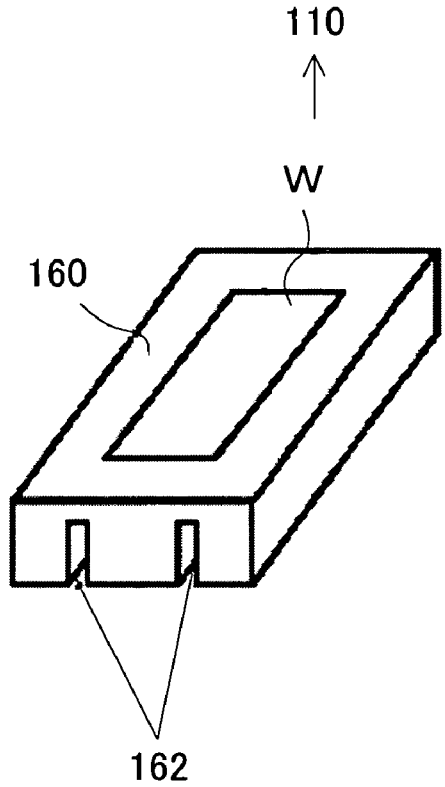
Figure 5:
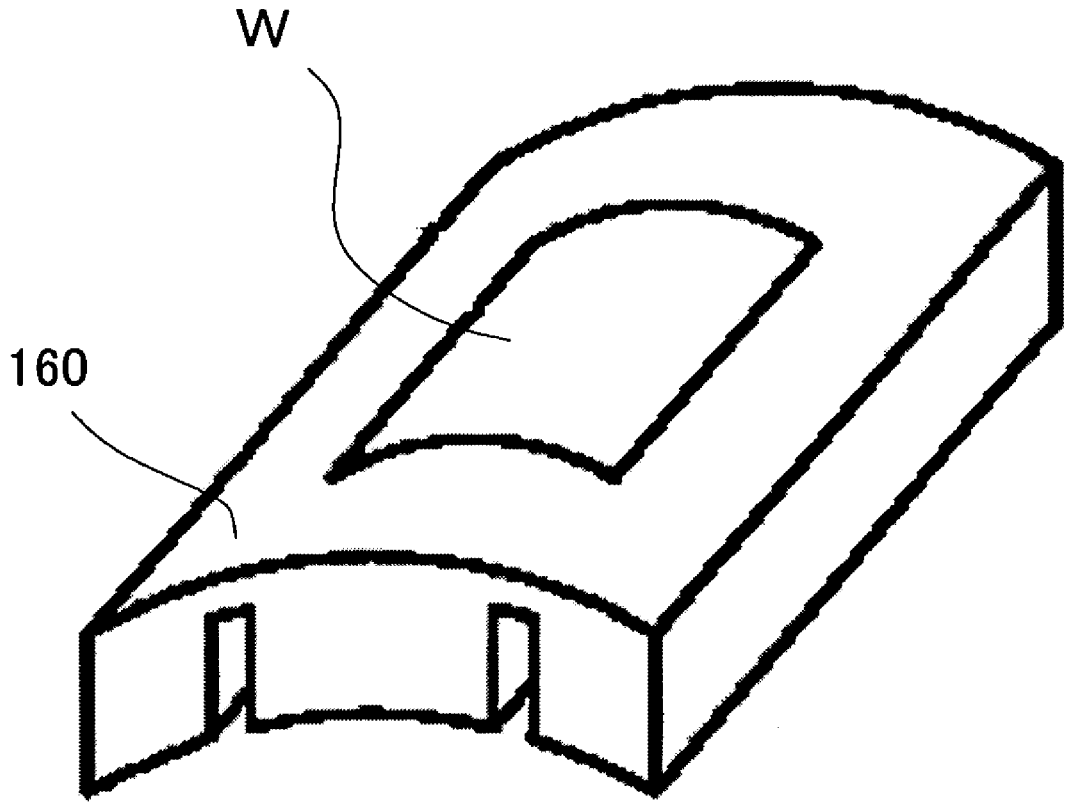
FIG. 5 is a perspective view showing an elastic deformation of the processing jig mounted with the work shown in FIG. 4.

Referring now to FIGS. 3 to 7, a description will be given of the processing jig 160. Here, FIG. 3 is a perspective view of an example of a target shape of the work W. FIGS. 4A and 4B show one example of the processing jig 160 for producing a shape shown in FIG. 3A. FIG. 4A is a perspective view of the processing jig 160 mounted with the work W with its side of the lapping machine 110 facing down. FIG. 4B is a perspective view of the processing jig 160 with its side of the lapping machine 110 facing up. FIG. 5 is a perspective view showing an elastic deformation of the processing jig 160 shown in FIGS. 4A and 4B.

The processing jig 160 is mounted with the work W, is supported by the processing head 150, and elastically deforms with the work W in response to the load applied by the processing head 150. The jig 160 makes it unnecessary to directly provide many application points, for example, on a small work W having an area of 500 $mm^2$ or smaller and a thin work W having a thickness of 1 mm or smaller. The jig 160 is larger than the work W, and it is easy to provide many application points on the jig 160. In addition, the jig 160 is thicker than the work W, and less likely to get damaged by the load applied by the application points. However, the present invention does not limit the work W to the small and/or thin type, because the jig 160 has a meritorious effect even when the work W is large due to the easy application of the tensile load and the cost reduction by reducing the number of actuators.

The jig 160 should be made of a highly rigid material as stainless steel or ceramics so that the rigidity of the work W can maintain a linear portion of a target shape during processing of the work W into the target shape. For example, in FIG. 3A, the y direction is a linear direction.

The jig 160 includes a guide mechanism 162 that elastically deforms into a predetermined shape when receiving the load at a predetermined position. The guide mechanism elastically deforms the processing jig with the work. One illustrative guide mechanism is, for example, a pair of guide grooves shown in FIGS. 4A and 4B. A desired contact pressure distribution occurs on the polished surface $W_1$ when the elastically deformed work W is pressed against the polishing surface 111 of the lapping machine 110. The jig 160 having the guide mechanism shown in FIGS. 4A and 4B may be made, for example, by injection molding or machining of metals.

While the jig 160 shown in FIGS. 4A and 4B has a rectangular parallelepiped shape, the present invention does not limit the shapes of the jig 160 and a mounting part that mounts the work W. For example, when the work W is a disc shape like a wafer, the mounting part has a disc shape and the outline shape becomes cylindrical.

Thus, this embodiment provides the jig 160 attached to the work W with the load that elastically deforms the work W and the jig 160, and generates a desired polishing pressure distribution while maintaining a deformation of the work W, rather than applying the compression load directly to the back surface opposing to the work W's polished surface $W_1$ against the lapping machine 110 and enhancing the contact pressure locally. Therefore, this embodiment utilizes the optimized deformation shape of the jig 160 so as to generate a desired contact distribution.

An illustrative target shape shown in FIG. 3A characteristically has a curvature in the x direction and linearity in the y direction. In order to polish this target shape, the conventional method arranges many actuators along the y direction so as to maintain the linearity in the y direction.

On the other hand, this embodiment uses the jig 160 shown in FIGS. 4A and 4B, which has a pair of guide grooves 162 along the y direction in the plate. The jig 160 thus preferably includes a guide mechanism, such as a guide groove, in an integrated component. The integrated component solves a problem of a surface orientation adjustment.

The jig 160 elastically deforms as shown in FIG. 5 as the load is applied as shown in FIG. 4A to a load applied portion 165 at a back center of the jig 160, while the work W is bonded to this jig 160 as shown in FIG. 4B and both side surfaces of the jig 160 are attached to the holder 153 in the processing head 150. The one-point load is approximated to the target shape, because the processing jig easily bends in the y direction and is rigid in the x direction due to the guide grooves.

While this is an example of a guide mechanism that maintains the linearity of the target shape using the rigidity of the jig, the linear inclination shown in FIG. 6A can be maintained by the actuators 152 at two end points, as shown in FIG. 6B, by providing the jig 160A with the rotational center 163. Here, FIGS. 6A and 6B are sectional views for explaining an effect of the processing jig 160A. More specifically, FIG. 6A shows a relationship between the load applied to the work W from the actuator 152 and the pressure distribution when the jig 160A is not used. FIG. 6B shows a relationship between the load applied to the work W from the actuator 152 and the pressure distribution when the jig 160A is used.

The inventive processing jig 160 intends to cover all the types of jigs that elastically deform the work W into a desired shape by combining basic structures.

FIGS. 3B and 3C are perspective views showing other illustrative target shapes of the work W. FIGS. 7A-7F are perspective views of a processing jig 160B used to form the shapes of FIGS. 3B and 3C. More specifically, FIG. 7A is a plane view of the processing jig 160 mounted with the work W, and FIG. 7B is a bottom view of it. FIG. 7C is a sectional view taken along a centerline A-A in FIG. 7A. FIG. 7D is a sectional view taken along a line B-B in FIG. 7A. FIG. 7E is a sectional view taken along a centerline C-C in FIG. 7A. FIG. 7F is a sectional view taken along a line D-D shown in FIG. 7A.

The target shapes in this embodiment deforms in opposing directions at both ends, as shown in FIGS. 3B and 3C, in addition to the condition in an example shown in FIG. 3A (i.e., that provides the curvature in the x direction and the linearity in the y direction).

For the shape shown in FIGS. 3B and 3C, the processing jig 160B includes a guide mechanism that has two guide grooves 162B (i.e., 162$B_1$ and 162$B_2$) with a rotating function, as shown in FIGS. 7C to 7F. FIGS. 7A-7D provides a cylindrical part 164B at the tip of the guide groove 162B because a wire forms each guide groove 162B and the cylindrical part 164B is an insertion hole for the wire. Due to the use of wire, each guide groove 162B perforates to the opposite surface. For example, the guide groove 162$B_1$ perforates from the right surface in FIG. 7A to the left surface (not shown). The four guide grooves 162$B_2$ perforate from the top surface to the bottom surface in FIG. 7A, but do not reach the surface that mounts the work W. The guide mechanism 162B that uses two types of guide grooves maintains the linearity at both ends in the shape shown in FIGS. 3B and 3C in the x direction, and defines the shape shown in FIG. 3B.

The jig 160B includes a mounting part 161B that mounts the work W, on the surface 160$B_1$, and four load applied portions 165B to which the processing head 150B applies four deformation loads, on the surface 160$B_2$. As shown in FIG. 7A, the mounting part 161B is formed into an approximately rectangular shape by a wire cut discharge process. For improved bonding strength of the work W, the work bonding surface preferably has a groove or hole. Thereby, the bonding area increases between the adhesive layer and the mounting part 161B, although the bonding area does not change between the work W and the adhesive layer.

In addition, as shown in FIG. 7B, the load applied portion 165B is also formed by the wire. The centers of four load applied portions 165B approximately form a square on the surface at the side of the processing head 150B of the jig 160B, and a part other than the load applied portion 165B serves as a fixing part 169 that does not deform the shaping part. The fixing part 169 is structurally independent of the rotating lever part 165C, which will be described later, and does not deform because of a rotation of the rotating lever part 165C. The jig 165B requires highly precise control over the surface shape of the shaping part, and preferably uses a material made of a low coefficient of thermal expansion.

Referring to FIG. 7D, the guide groove 162$B_1$ and the load applied portion 165B form part of the concave rotating lever part 165C. As a result, for example, when one of the load applied portions 165 (e.g., the upper load applied portion 165B) that form the concave projection is pressed, the other (e.g., the lower) load applied portion 165 projects around the rotating center 163B, like a seesaw. The two rotating lever parts 165C deforms the shaping part into an arbitrarily curved shape. The jig 165B integrates the shaping part, the rotating lever part 165C, and the fixing part 169 with each other.

The jig 160B is fixed onto the processing head 150B, which will be described later, via a pair of stepped attachment holes 167. The stepped attachment holes 167 are merely one example, and may be replaced with any means known in the art as long as the jig 160B is fixed onto the processing head 150. The jig 160B further has a pair of holes 168. A pair of butting members are inserted into the pair of holes 168 to maintain the work W at the same position.

Figure 14:
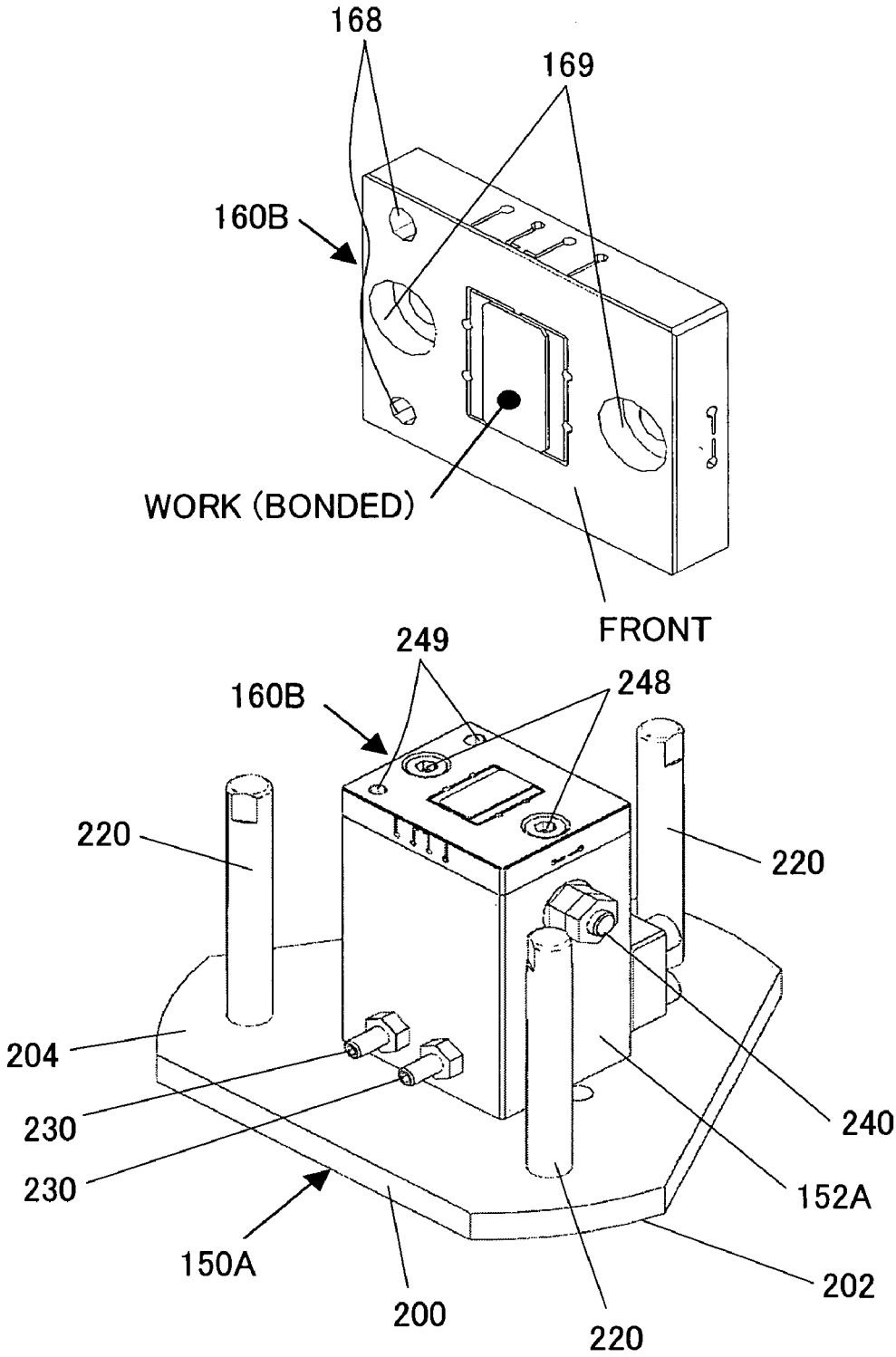
FIG. 14 is a perspective view of another processing head used for a processing apparatus shown in FIG. 1 with the processing jig shown in FIG. 7.
Figure 15:
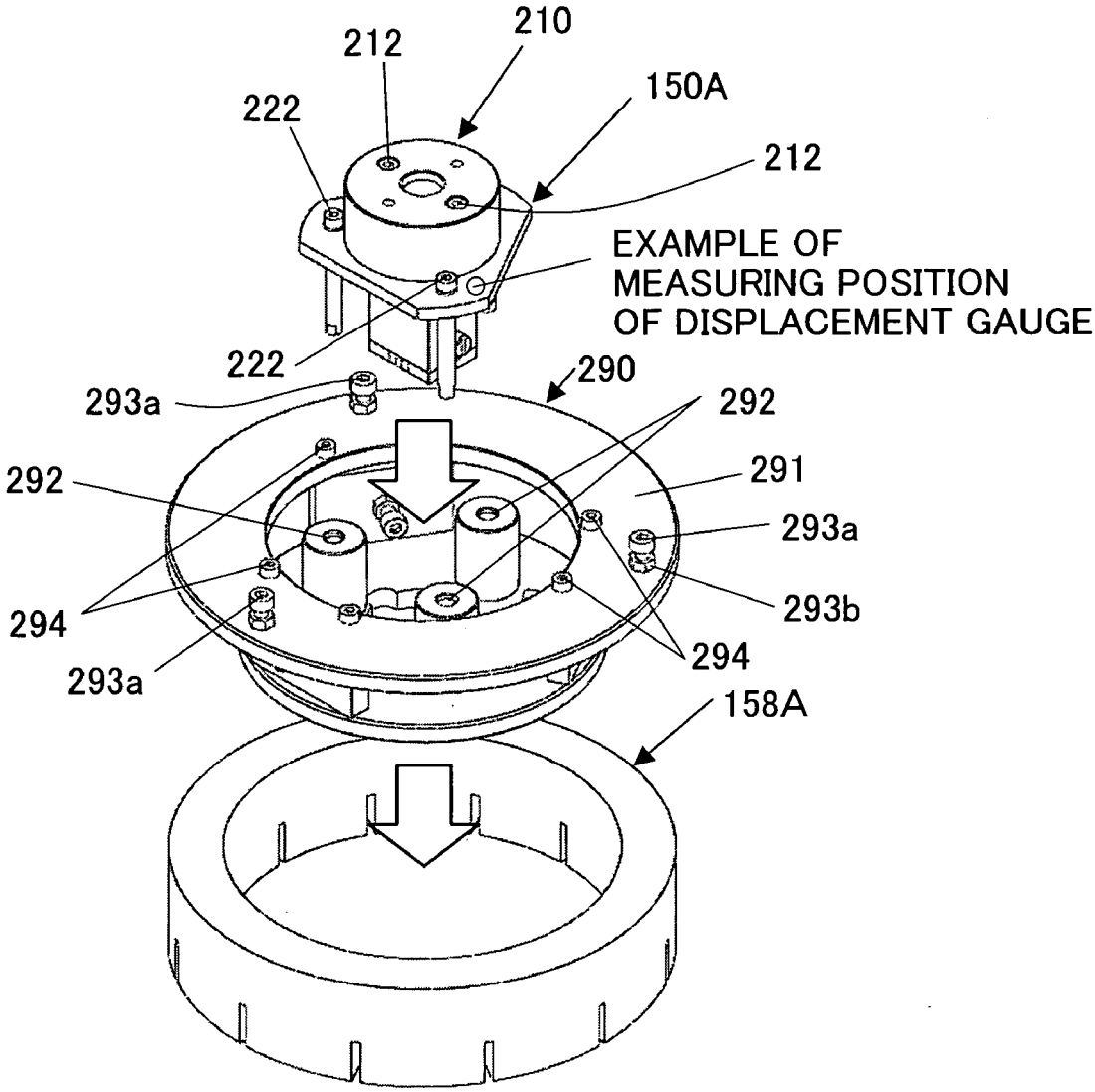
FIG. 15 is an exploded perspective view for explaining an assembly of the processing head, processing base, and correction ring.
Figure 16:
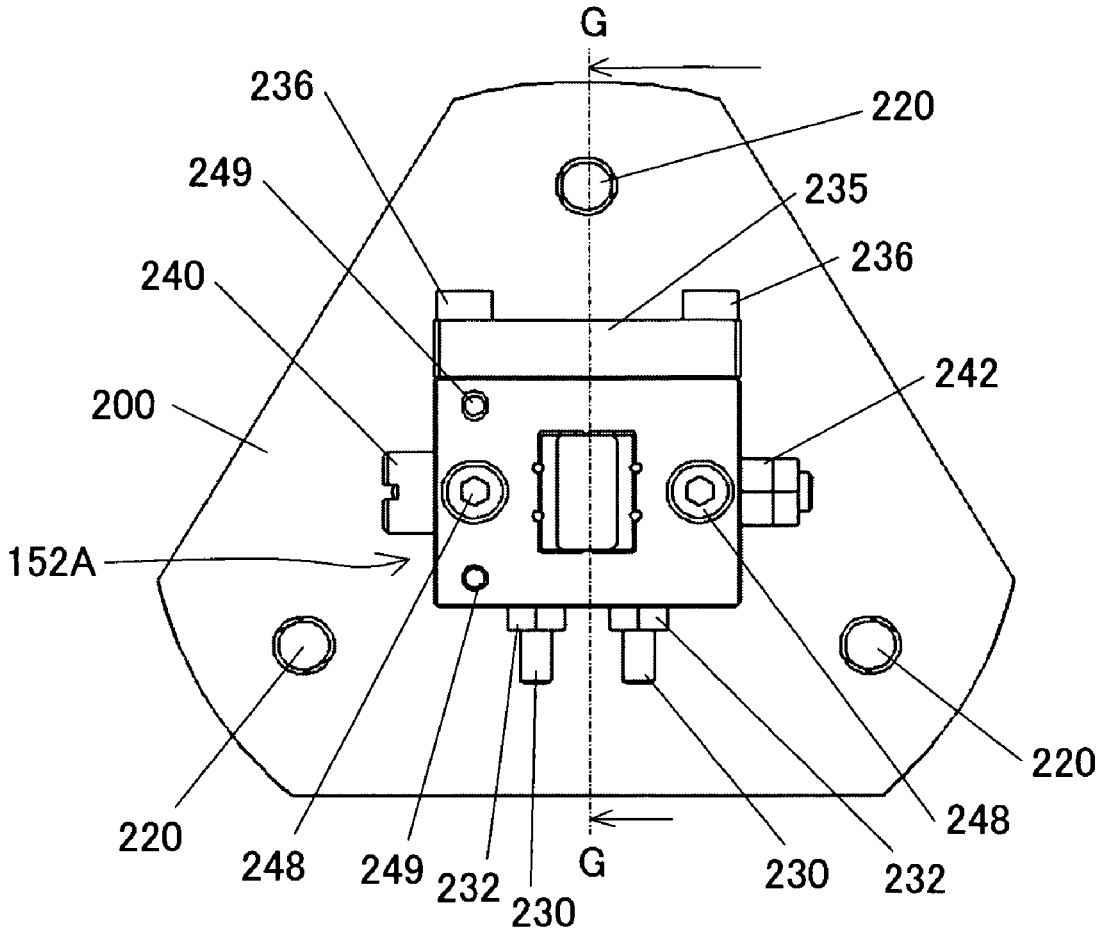
FIG. 16 is a plane view of the processing head shown in FIG. 14.
Figure 17A:
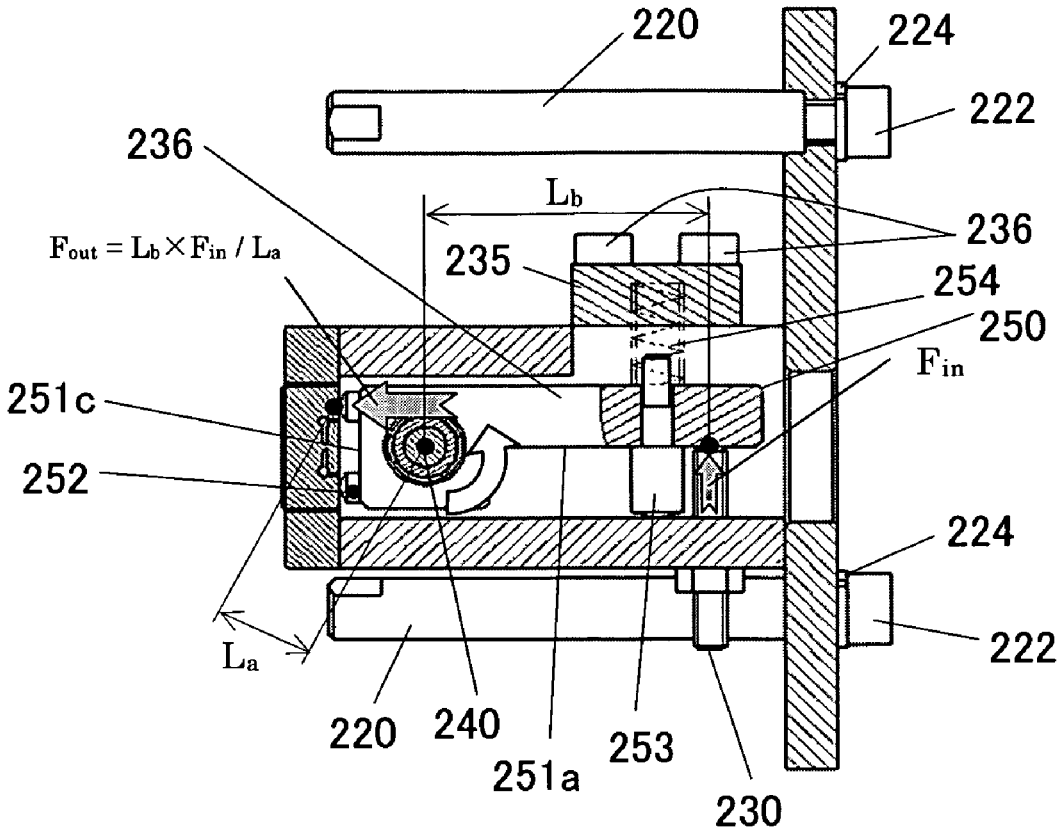
FIGS. 17A and 17B are a G-G sectional view of the processing head shown in FIG. 16 and a plane view of a compression block.
Figure 17B:
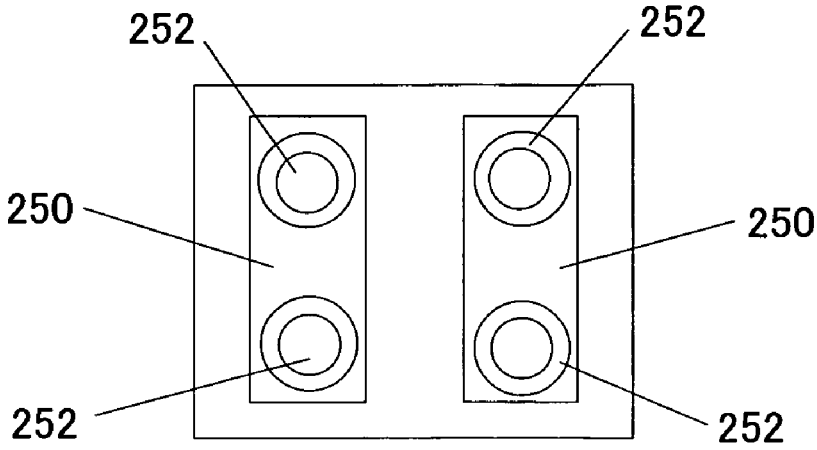
Figure 18:
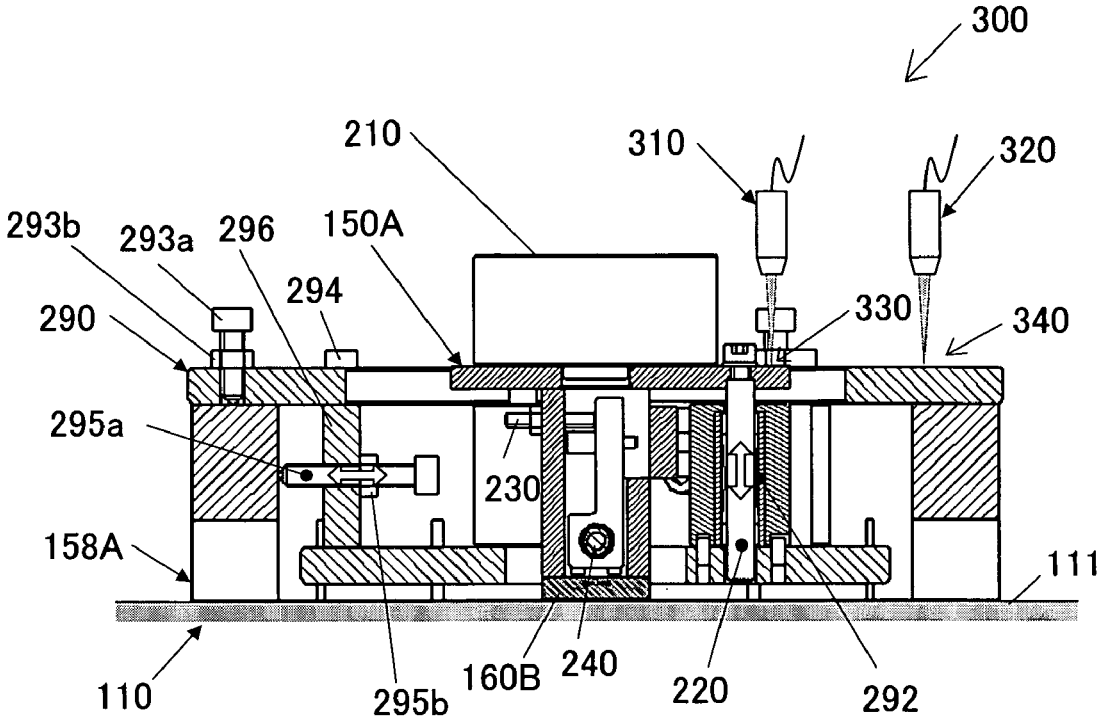
FIG. 18 is a sectional view of an assembled structure shown in FIG. 15.

Referring now to FIGS. 14 to 18, a description will be given of a compression mechanism used for the jig 160B shown in FIGS. 7A to 7F. The compression mechanism includes a processing head 150A, a processing base 290, a correction ring 158A, and a measuring system 300. Here, FIG. 14 is a perspective view for explaining a relationship between the processing head 150A and the jig 160B. FIG. 15 is an exploded perspective view for explaining an assembly of the compression mechanism. FIG. 16 is a plane view of the processing head 150A. FIG. 17A is a G-G sectional view of the processing head 150 shown in FIG. 16. FIG. 17B is a plane view of a pair of compression block 250. FIG. 18 is a sectional view of the assembled compression mechanism shown in FIG. 15.

The processing head 150A includes an equilateral triangle plate base 200, a weight 210, and three shafts 220, and an actuator 152A. A shape of the base 200 may be a circle or a rectangle, and the number of the weights 210 and shafts 220 and shapes of the weight 210 and shaft 220 are not limited. However, the number of shafts 220 is preferably three.

The base 200 has a first surface 202 and a second surface 204, and is made of stainless steel, for example. The weight 210 that compresses the jig 160B and the work W against the polishing surface 111 is attached to the first surface 202 via a pair of screws 212 as shown in FIG. 15. A driving means (not shown) is connected to the weight 210 and serves as a compressing and swinging mechanism 151.

The three shafts 220 shown in FIG. 14 are fixed onto the second surface 204 of the base 200 via three screws 222 and washers 224 shown in FIGS. 15 and 17. This embodiment arranges the three shafts 220 are arranged at the apexes of the equilateral triangle. The three shafts 20 are inserted into linear bushes 292 of the processing base 290 shown in FIG. 15. The processing head 150A perpendicularly moves relative to the processing base 290.

The rectangular actuator 152A is fixed at the center of the second surface 204 of the base 200. The top shape of the actuator 152A corresponds to the outer shape of the jig 160B, and fixes the jig 160B onto the top surface by inserting a pair of bolts 248 into the stepped attachment holes 167, and by inserting a pair of hook pins 249 into the holes 168, as shown in FIG. 16. One side surface of the actuator 152A is provided with a pair of compression screws 230 that apply a deformation force to deform the jig 160B, and a spring fixing block 235 is fixed onto a surface opposing to the side surface via four block fixing bolts 236. Each compression spring 230 is fixed onto the actuator 152A via the nut 232. The shaft 240 that assists a transmission of the deformation force by the compression spring 230 perforates through the actuator 152A and the side surface orthogonal to the actuator 152A, and is fixed via the nut 242. A pair of compression blocks 250 are provided in the actuator 152A. Each compression screw 230 is provided for each compression block 250, and the shaft 240 is commonly used for the pair of compression blocks 250.

Each compression block 250 has an L-shaped sectional shape as shown in FIGS. 17 and 18, contacts one corresponding compression screw 230, and is perforated and supported by the shaft 240 so that the compression block 250 can rotate around the shaft 240. The compression block 250 serves to apply a deformation force to the jig 160, and includes a pair of compression pins 252, one bolt 253, and one compression spring 254. As shown in FIG. 17B, each compression block 250 has a rectangular shape when viewed from the top, and exposes a pair of compression pins 252. The compression pins 252 are arranged like a square similar to the load applied portion 165B.

Each compression block 250 contacts a surface 251*a* via the compression screw 230 and the nut 232. The compression force $F_{in}$ by the compression screw 230 against the compression block 250 is adjustable by fastening and loosing the nut 232. The pair of compression screws 230 moves one of the pair of compression pins 252 of the compression block 250 in a longitudinal direction. A pair of compression pins 252 apply the deformation force to a pair of load applied portion 165B of the jig 160B are provided on the surface 251*c* of the compression block 250. This embodiment manually applies the compression force $F_{in}$ by the compression screw 230, while another embodiment automatically applies the compression force $F_{in}$ using an apparatus having a compression spring function.

The bolt 253 perforates a surface 261*a* and a surface 261*b* opposing to the surface 261*a* of the compression block 250. One end of the compression spring 254 contacts the surface 261*b* of the compression block 250 and compresses the surface 261*b*. The compression spring 254 houses the perforated bolt 253. The other end of the compression spring 254 is fixed onto the spring fixing block 235. The shaft 240 is provided between a pair of compression pins 252, and serves as a fulcrum. In other words, in the compression block 250 at the left side in FIG. 17B, as the upper compression pin 252 projects from the actuator 152A, the lower compression pin 252 retreats into the actuator 152A.

The compression force $F_{out}$ that affects the upper compression pin 252 in FIG. 17A is given by $F_{out}=L_b \times F_{in}/L_a$, where $L_a$ is a distance between the shaft 240 and the upper compression pin 252, and $L_b$ is a distance between the shaft 240 and the compression screw 230. Understandably, when the compression screw 230 projects into the actuator 152A, the force is applied in the arrow direction shown in FIG. 17A, and when the compression screw 230 retreats from the actuator 152A, the compression spring 254 rotates the compression block 254 counterclockwise in FIG. 17, force is applied opposite to the arrow direction.

As shown in FIGS. 15 and 18, the processing base 290 includes a bracket 291, three linear bushes 292, three inclination adjusting screws 293*a* and nuts 293*b*, three screws 294, three decentering amount adjusting screws 295*a* and 295*b*, and three fixing plates 296.

The bracket 291 is placed on a top surface of the correction ring 158A. The three linear bushes 292 are provided at intervals of 120°, and houses, fixes and precisely positions the shaft 220. In FIG. 15, the shaft 220 of the processing head 150A is convex, and the linear bush 292 of the processing base 290 is concave, but this relationship may be inverted. Three inclination adjusting screws 293*a* and 293*b* are provided at intervals of 120°, adjust a position of the bracket 291 relative to the top surface of the correction ring 158A, and maintain the parallelism of the bracket 291 relative to the polishing surface 111. Three pairs of screws 294 fix the fixing plates 296 that are arranged at intervals of 120°. The decentering amount adjusting screw 294 adjusts a distance with the inner diameter in the correction ring 158A, and determines the decentering amount of the processing base 290 or the work W. In this embodiment, this distance is about 10 mm.

The correction ring 158A serves similar to the correction ring 158, and thus a detailed description thereof will be omitted.

As shown in FIG. 18, the measuring system 300 includes a displacement gauge 310, a reference displacement gauge 320, a load applied portion 330 provided on the first surface 202 of the base 200 in the processing head 150A, and an object to be measured 340. The measuring system 300 serves as an external monitor that measures the processing amount at the work processing time as a height displacement of the processing head 150A.

Figure 19:
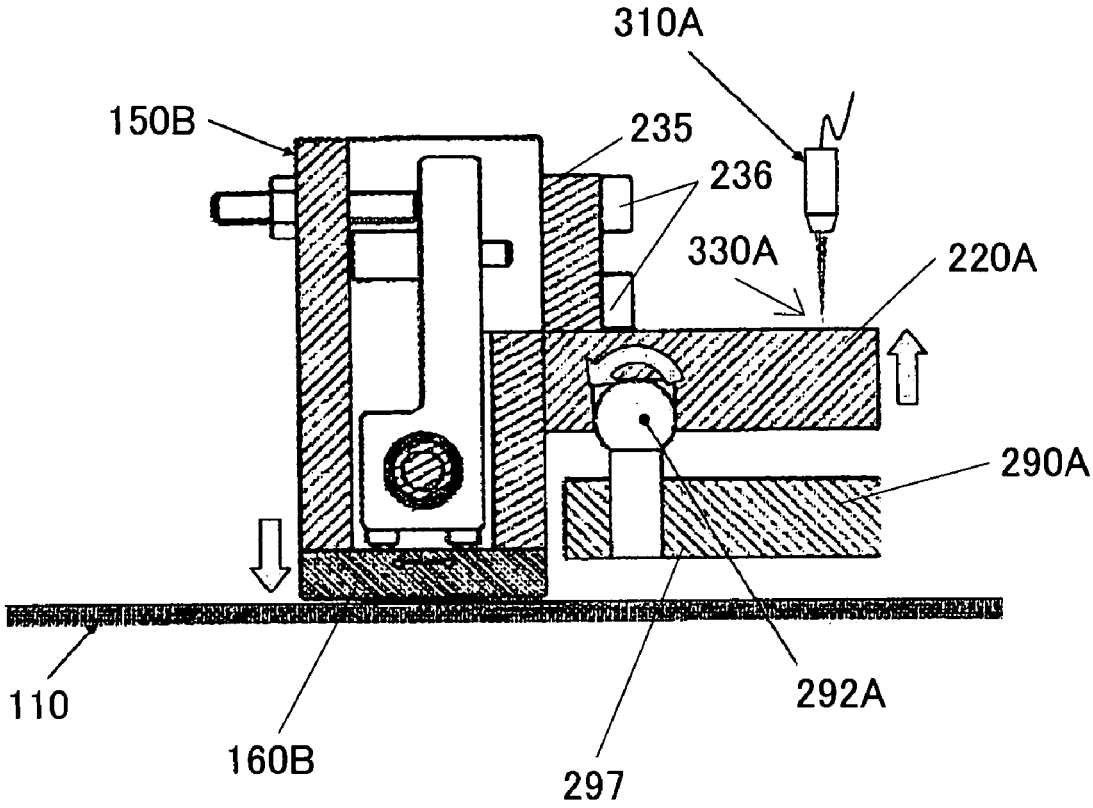
FIG. 19 is a sectional view showing a pivot as a variation of a linear bush of the processing base shown in FIGS. 16 and 18.

The present invention does not limit the positioning means of the processing head 150A to the linear bush. For example, as shown in FIG. 19, the positioning mechanism includes a hollow ring member 297 of a processing base 290A, one pivot 292A, and a plate member 220A fixed onto the processing head 150B.

The processing base 290A has a shape similar to that shown in FIG. 15, but has the hollow ring member 297 at the bottom opposing to the bracket 291. The hollow ring member 297 has one pivot 292A. Since the pivot 292A has a spherical top, the processing head 150B is supported at one point by the pivot 292A. Therefore, irrespective of the shape of the work W, the work W follows the lapping machine 110. A position of the work W is determined by two contact points between the work W and the lapping machine 110, and the pivot 292A. In the embodiment shown in FIG. 19, the measuring system, which will be described later, uses a displacement (or angle) gauge 310A to measure the angular displacement, and the object to be measured 330A is formed at the plate member 220A. The embodiment shown in FIG. 19 similarly provides the reference displacement (or angle) gauge, and corresponding object to be measured.

The controller 170 controls each component, in particular the polishing amount of the work W so as to form the work W into a desired shape. In this embodiment, the controller 170 controls the contact pressure P against the polishing surface 111 of the work W's polished surface $W_1$, and thereby controls the polishing amount R of the work W.

The polishing amount R in the lapping is proportionate to the P, V and t in accordance with the following Preston's relational equation, where K is a proportionality factor, P is a contact pressure of the work W's polished surface $W_1$, V is a relative speed between the work W and the lapping machine 110, and t is a polishing time:

$$R=K\cdot P\cdot V\cdot t \qquad \text{[EQUATION 1]}$$

Figure 9:
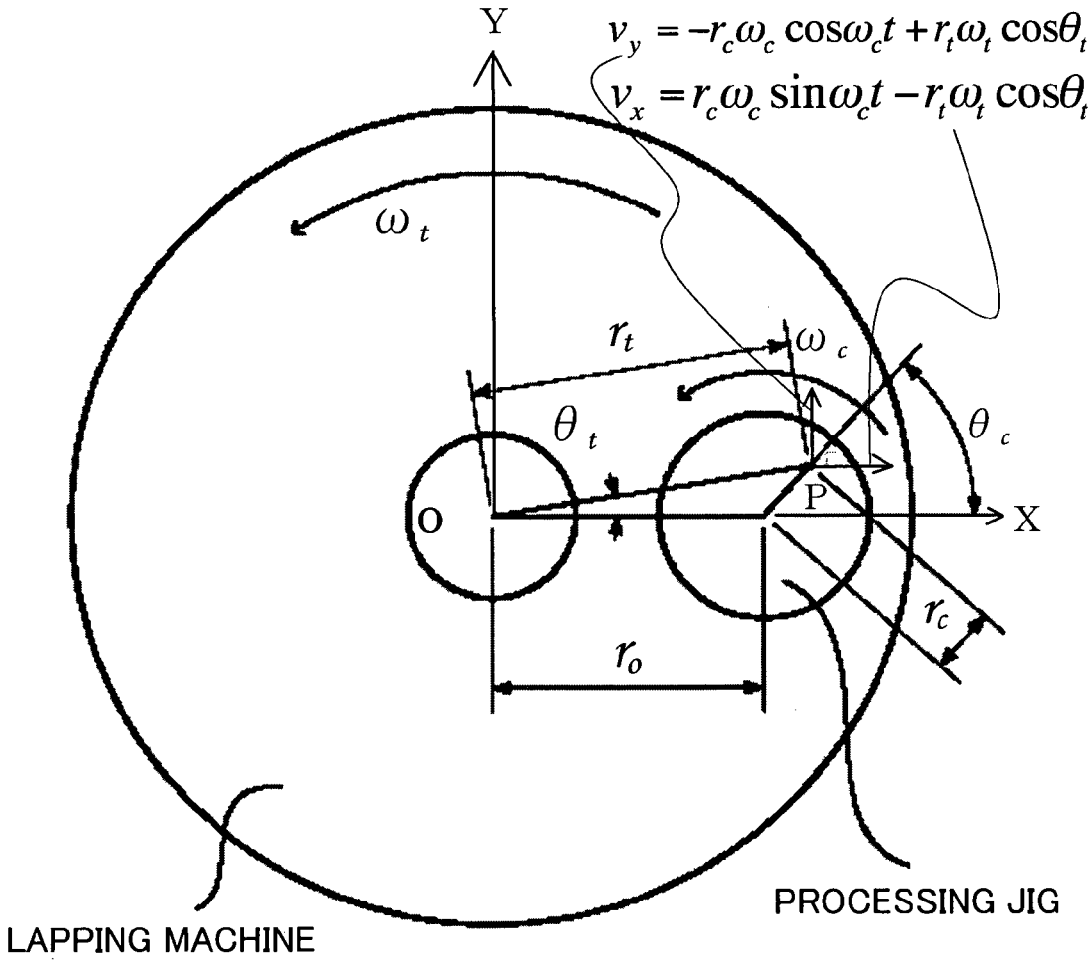
FIG. 9 is a view for explaining an equation used to calculate the relative speed between the work and the polishing surface in the processing apparatus shown in FIG. 1.

Therefore, it is necessary for the desired polishing amount R to control the relative speed distribution and the contact pressure distribution of the polishing surface 111. The polishing time t is the same on any locations on the polishing surface 111, and may be ignored here. "$v_x$" is a relative speed (x component) at the point P on the work. "$v_y$" is a relative speed (y component) at the point P on the work. "$w_t$" is an angular speed of the lapping machine. "$w_c$" is an angular speed of the processing jig. $r_0$ is a distance between the rotational center of the lapping machine and the rotational center of the work. "$r_c$" is a distance from the rotational center of the work and the point P on the work. "$r_t$" is a distance between the rotational center of the lapping machine and the point P. "$\theta_t$" is an angle between the rotational center of the lapping machine to the point P on the work. "$\theta_c$" is an angle between the rotational center of the work to the point P on the work. The relative speed V can be calculated as shown in FIG. 9 since the locus of the work W on the lapping machine 110 is known. If the relative speed is hardly changed by the lapping machine 110, the work W's outline, and the work W's locus, the relative speed can be ignored. Therefore, it is only the contact pressure P that is necessary for the control over the polishing amount, and control over the contact pressure P would result in the desired polishing amount distribution. The controller in this embodiment uses the actuator 152 to control the contact pressure P at the lapping time.

A description will be given of the control method according to the instant embodiment of the present invention. The control over the contact pressure needs a relational equation between the deformation amount of the work W and the contact pressure P. In such a case, a structure analysis approach, such as the finite element method ("FEM"), may provide a contact pressure at a certain deformation time, but the contact problem is nonlinear and takes time for calculation. In addition, the compression always varies the shape and frequent repetitive recalculations. Therefore, the control software cannot be used. Accordingly, this embodiment calculates the approximate solution by the following method, and applies it to the control.

For calculational simplicity, this embodiment calculates the approximate solution of the contact pressure P on the following premise:

(1) There is a linear relationship between the given load and the deformation amount.

Figure 10:
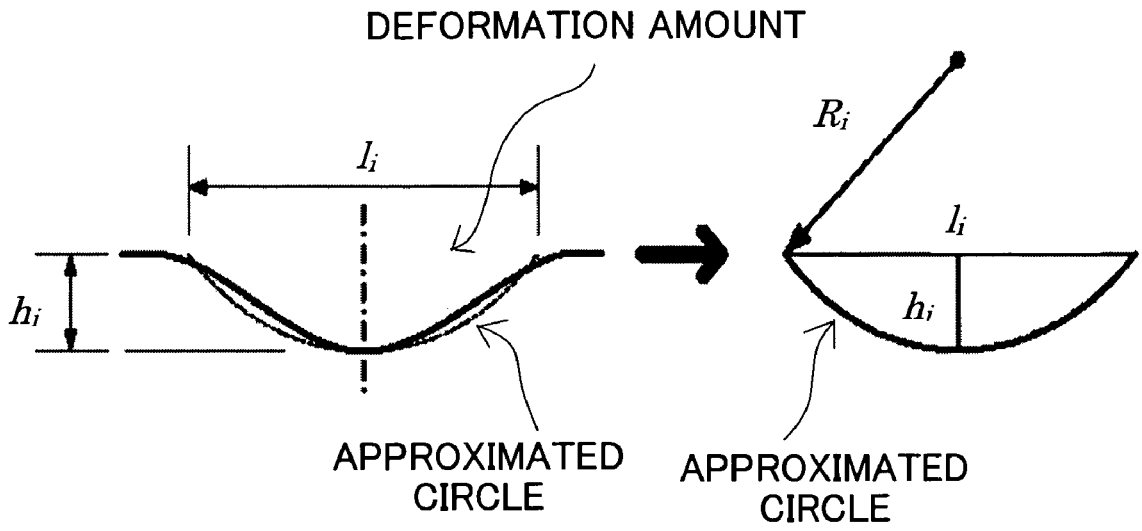
FIG. 10 is a view for explaining the arc approximation of the deformation amount.

(2) As shown in FIG. 10, the contact pressure P is calculated as a Hertz's contact problem by approximating the work W's deformation by the arc or sphere.

Regarding the premise (1), the contact is originally a nonlinear problem but this embodiment assumes that the work W's deformation is minute within an elastic deformation range, and this premise provides a sufficiently satisfactory solution. An assumption of a linear relationship between the load and the deformation amount facilitates the calculation of the work W's deformation amount at the arbitrary load application. If the FEM tool etc. are used to calculate the work W's deformation amount when the reference load is previously given, a ratio between the reference load value and the arbitrary value provides a calculation of the work W's deformation amount, greatly reducing the calculation amount.

Even regarding the premise (2), the work W's deformation is minute in this embodiment and can be approximated by the arc with high approximation accuracy. The following equation gives a radius R of the approximated circle using a deformation width li and the deformation amount hi.

$$R_i = \frac{1}{2h_i}\left(\frac{l_i^2}{4} + h_i^2\right) \qquad \text{EQUATION 2}$$

The following Hertz's contact theory applies to the spherically approximated work W's deformation: Equation 3 defines a radius of the contact surface. Equation 4 defines a contact pressure that occurs on the contact surface center. Equation 5 defines the pressure on the contact surface.

$$a^3 = \frac{3}{4}R_i\left(\frac{1-v_1^2}{E_1} + \frac{1-v_2^1}{E_2}\right)L_i \qquad \text{EQUATION 3}$$

$$p_i^3 = \frac{6}{\pi^3}\cdot\frac{1}{R_i^2}\cdot\frac{L_i}{\left(\frac{1-v_1^2}{E_1} + \frac{1-v_2^2}{E_2}\right)^2} \qquad \text{EQUATION 4}$$

$$P_i = p_i\sqrt{1-\frac{r^2}{a^2}} \qquad \text{EQUATION 5}$$

"Pi" is a contact pressure at the point r on the contact surface. "pi" is a pressure at the center of the contact surface. "a" is a radius of the contact circle. "r" is a distance from the center of the contact circle. "Ri" is a radius of a sphere. "Li" is an applied load. "$E_1$" is a Young's modulus of the plane. "$E_2$" is a Young's modulus of the sphere. "$v_1$" is a Poisson's ratio of the plane. "$v_2$" is a Poisson's ratio of the sphere.

Thereby, the contact pressure P can be solved in the cubic polynominal order. The compression pressure at this time uses a value of the pressure applied to the entire work W divided by the ratio of each convex part area. The necessary load is calculated by the backward calculation of the necessary contact pressure based on the above theory.

Figure 11:
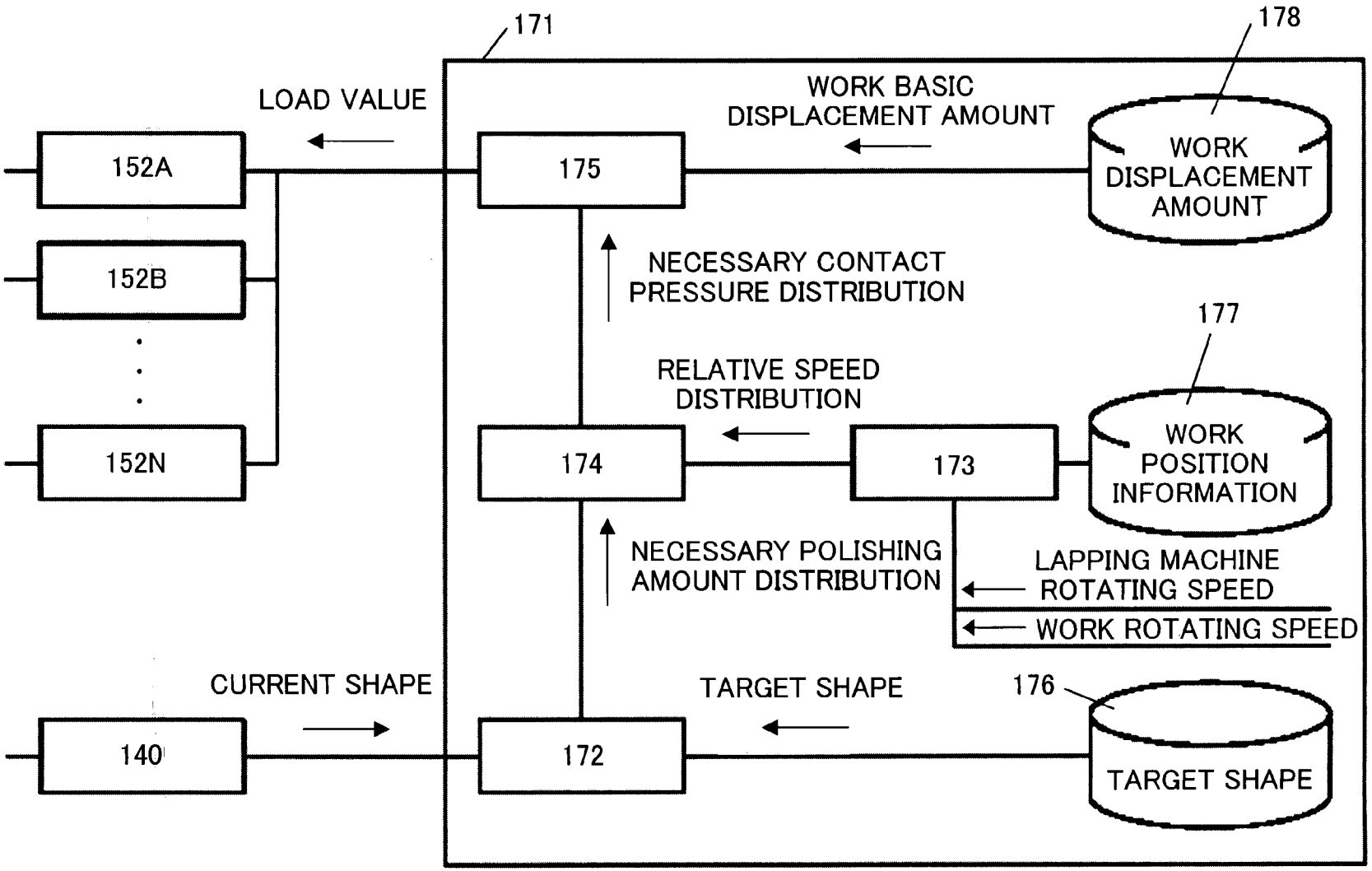
FIG. 11 is a block diagram of part of the controller shown in FIG. 1.

FIG. 11 shows a control block diagram of the load indicated value operating unit 171 in the controller 170. The control system in this embodiment inputs current shape data from the shape measuring apparatus 140 that measures the work's current shape, outputs the load indicated value to the actuators 152A to 1524A to 154N, and includes four types of operating units 172 to 175, and databases 176 to 178.

The polishing amount operating unit 172 receives the target shape stored in the database 176, which will be described later, and the current shape from the shape measuring apparatus 140, and outputs the necessary polishing amount distribution.

The relative speed operating unit 173 receives from the controller 170 the rotating speed of the lapping machine 110 and the rotating speed of the work W by the processing arm 130, and outputs the relative speed distribution of the work contact surface 111 from the positional information of the work W previously given from the database 177, which will be described later.

The contact pressure operating unit 174 receives the polishing amount distribution and the relative speed distribution from the polishing amount operating unit 172 and the relative speed operating unit 173, and outputs the necessary contact pressure distribution in accordance with the Preston's relational equation. The proportionality factor value is previously obtained by an experiment and another means.

The load operating unit 175 receives the necessary contact pressure distribution from the contact pressure operating unit 174, and outputs the load indicated value to be applied by the actuator 152 based on the deformation amount by the work's basic load value previously given by the database 178, which will be described later and backward calculation of the Hertz's contact equation. The controller 170 in the instant embodiment controls only the load applied by the actuator 152, an alternate embodiment may control the compression force applied by the pressurizing and swinging mechanism 151 in addition to or together with the load.

The database 176 stores a target shape shown in FIGS. 3A to 3C. The database 177 stores positional information of the work W, such as a distance from the rotational center of the lapping machine 110. The database 178 stores a deformation amount due to the basic load value of the work W.

Figure 20:
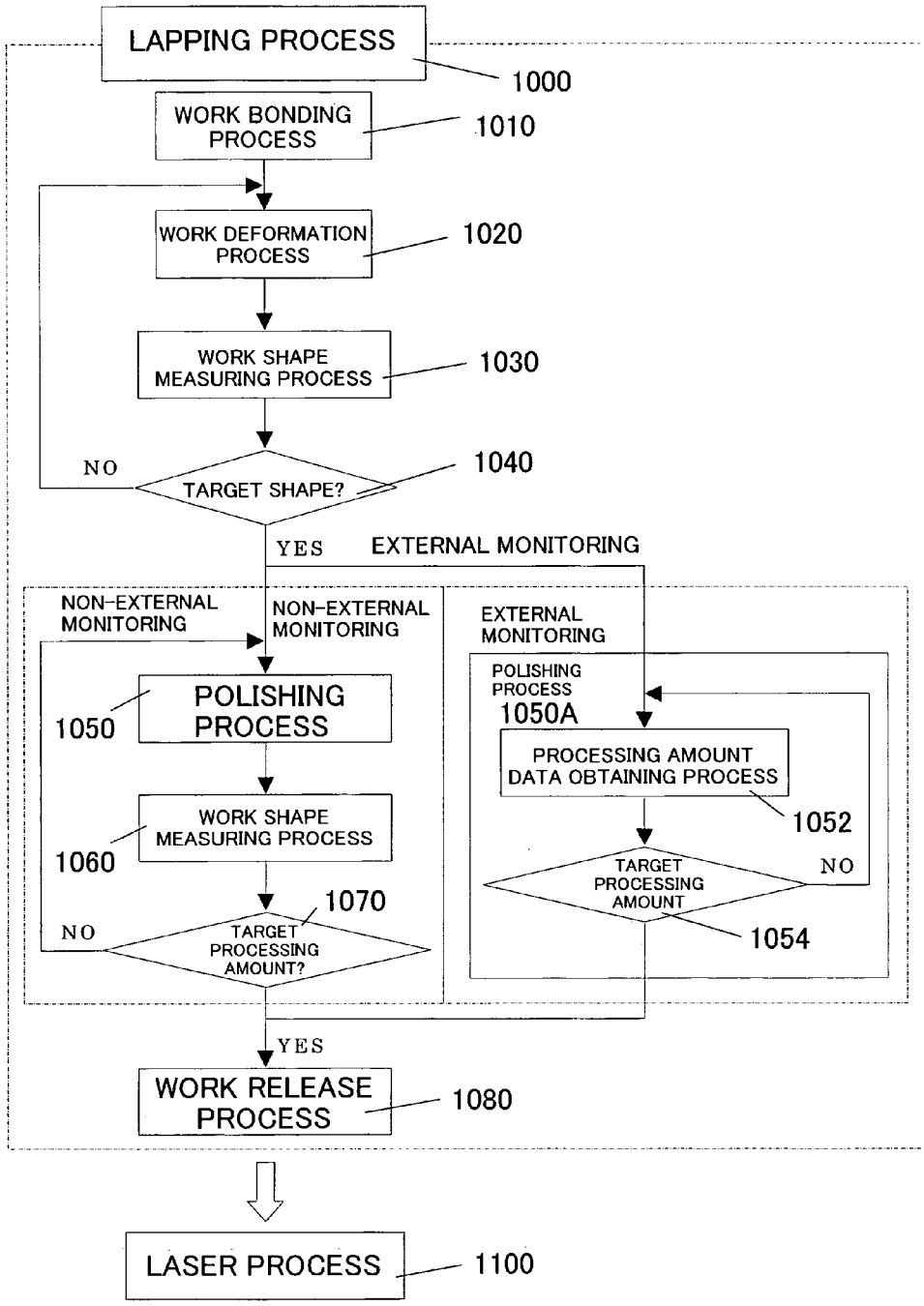
FIG. 20 is a flowchart for explaining a manufacturing method of a freely curved mirror shown in FIG. 3C.
Figure 21:
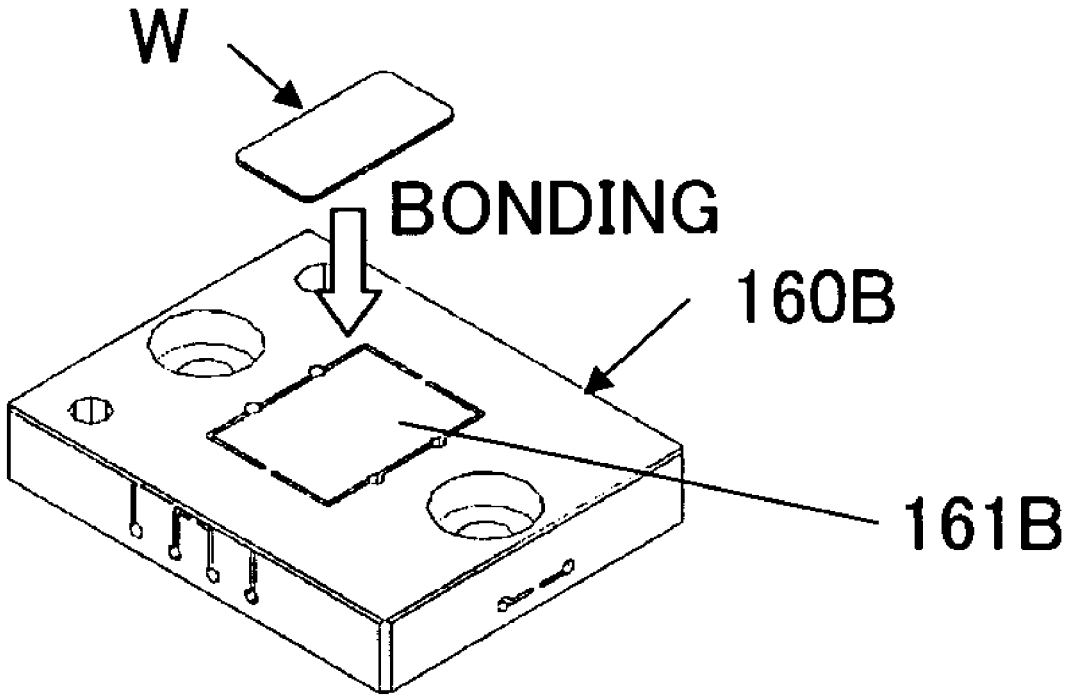
FIG. 21 is a perspective view for explaining a work bonding process in a wrapping process shown in FIG. 20.
Figure 22:
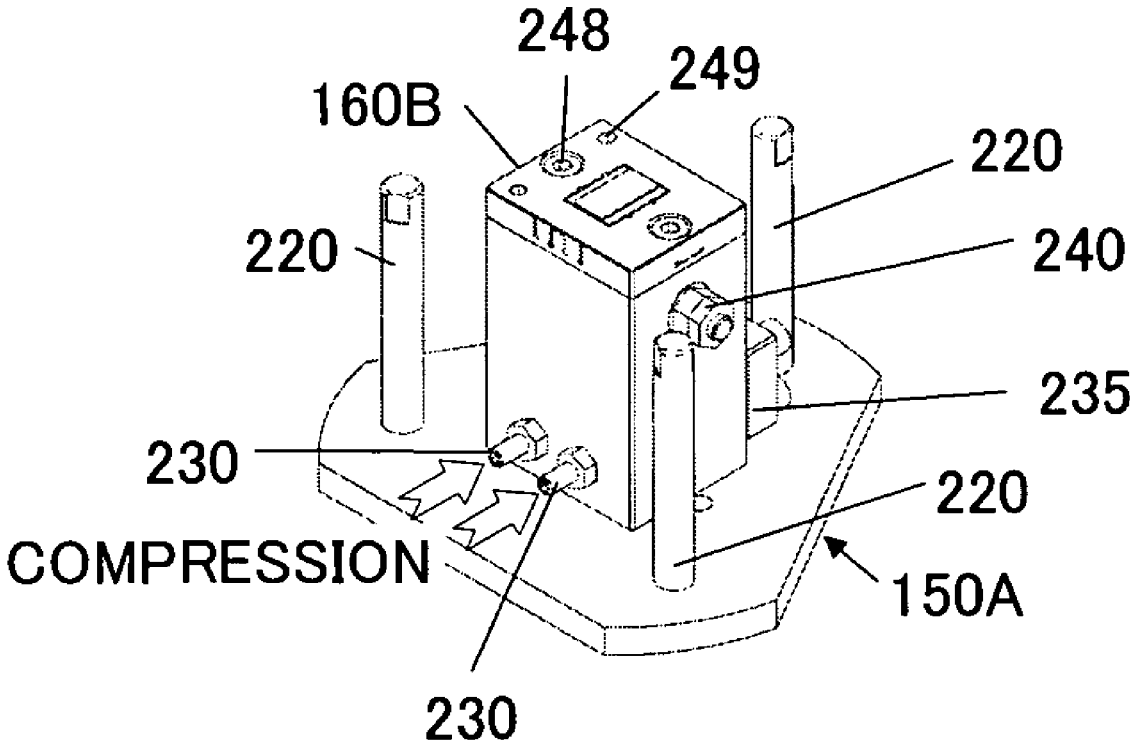
FIG. 22 is a perspective view for explaining a work deformation process in the lapping process shown in FIG. 20.
Figure 23:
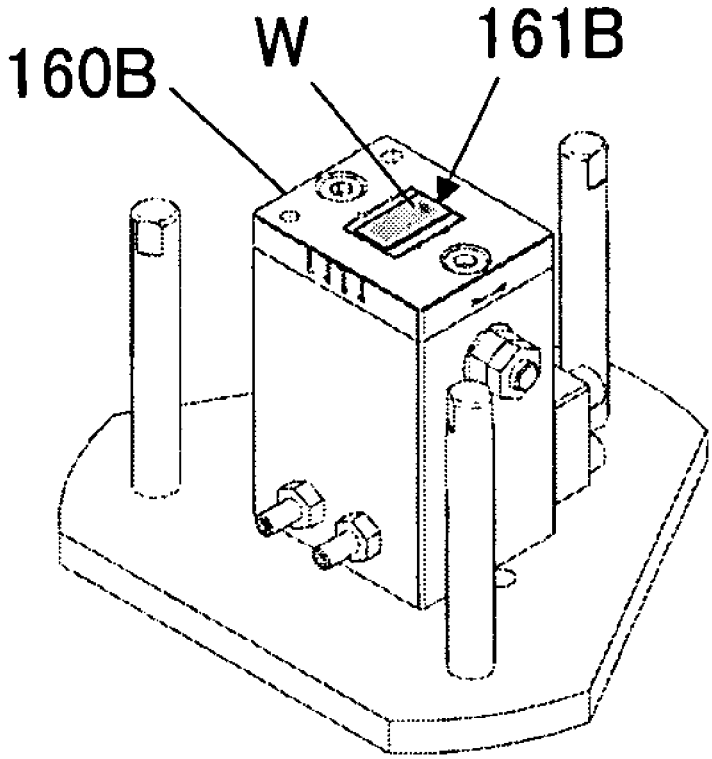
FIG. 23 is a perspective view for explaining a work shape measuring process in a lapping process shown in FIG. 20.
Figure 24A:
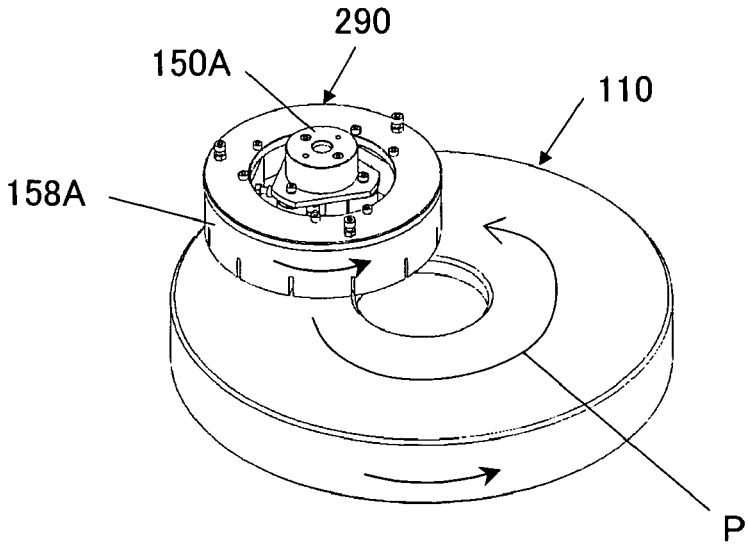
FIGS. 24A and 24B are perspective and plane views for explaining a polishing processing in the lapping process shown in FIG. 20.
Figure 24B:
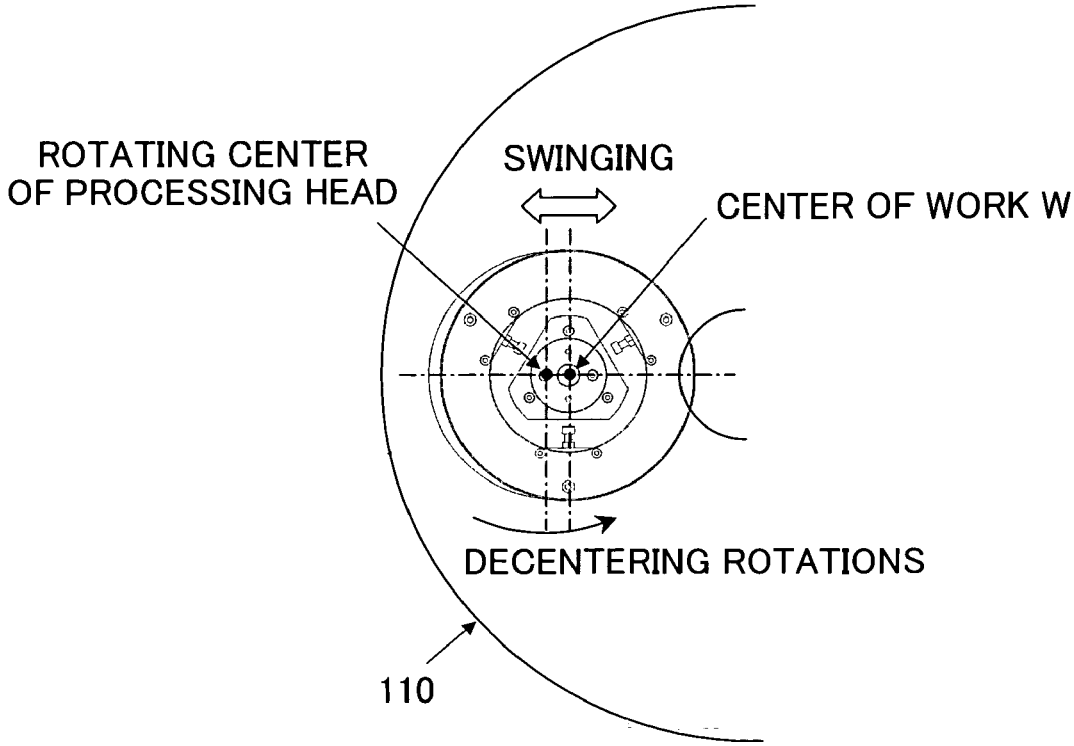
Figure 25:
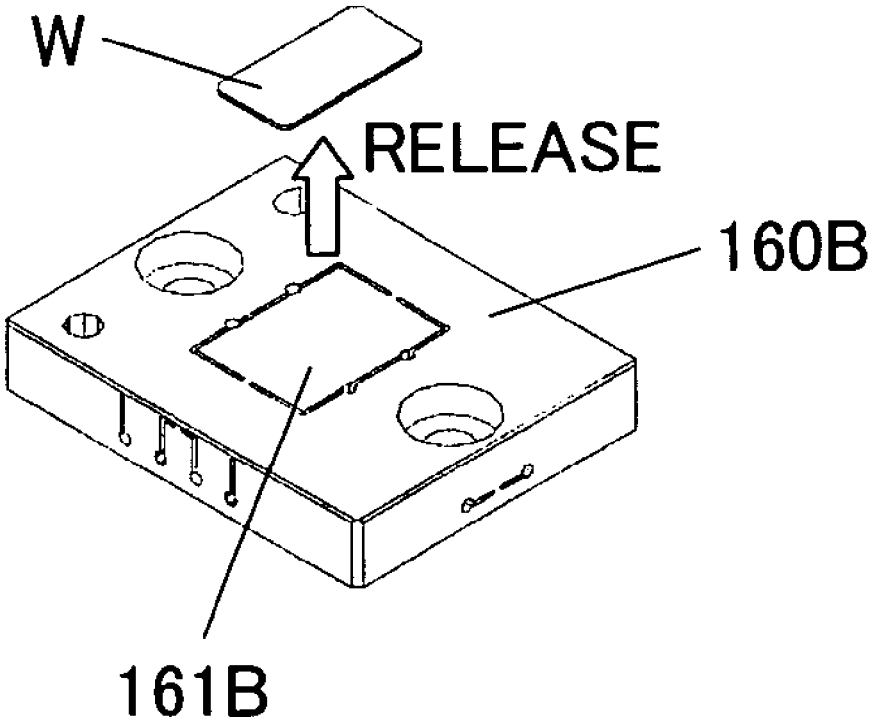
FIG. 25 is a perspective view for explaining a work release process in the lapping process shown in FIG. 20.

Referring now to FIGS. 20 to 25, a description will be given of a manufacturing method of a freely curved mirror shown in FIG. 3C using the processing apparatus 1100. Here, FIG. 20 is a flowchart for manufacturing the freely curved mirror. FIG. 21 is a perspective view for explaining a work bonding process in the lapping process. FIG. 22 is a work deformation process in the lapping process. FIG. 23 is a work shape measuring process in the lapping process. FIGS. 24A and 24B are perspective and plane views for explaining polishing processes in the lapping process. FIG. 25 is a work release process in the lapping process.

As a premise, the database 176 stores the target shape shown in FIG. 3C, and the coordinate information that defines coordinate information, such as a distance from the rotational center from the lapping machine 110. In addition, the database 178 stores the deformation amount due to the basic load value of the work W.

The manufacturing process includes a lapping process 1000 and a laser process 1100. The lapping process 1000 includes a work bonding process 1010, a work deformation process 1020, a work shape measuring process 1030, a polishing process 1050 or 1050A, and a work release process 1080.

The work bonding process 1010 bonds the work W to a mounting part 161B as a shaping part of the jig 160B as shown in FIG. 21. This embodiment uses wax as an adhesive agent and, and bonds the work W to the jig 160B in a heated state of about 100° C.

The work deformation process 1020 inserts a bolt 248 and a hook pin 249 into holes 167 and 168 and attaches the jig 160 bonded with the work W to the processing head 150A, as shown in FIG. 22. This embodiment sets the load of the weight 210 to about 600 g and the load applied to the work W to 1,000 g. Next, the deformation force $F_{out}$ is applied to the work W on the jig 160B via the compression screw 230 of the processing head 150B. In this embodiment, the work W's deformation amount is about several tens micrometers.

The work shape measuring process 1030 measures a shape of the deformed work W as shown in FIG. 23. The shape measurement can use, for example, a laser displacement gauge and a stylus displacement gauge. The work shape measuring process 1030 determines whether the work W has a target shape (step 1040), and deforms the work W again if necessary (a feedback from step 1040 to step 1020). When the work W reaches the target shape, the processing head 150A is attached to the processing base 290 or 290A, and then to the correction ring 158A.

Thus, instead of relying only upon local changes of the compression force used to compress the work W against the polishing surface 111, the processing method of this embodiment elastically deforms the jig 160 together with the work W by applying the load to a predetermined position of the jig 160. By providing a large jig 160 with application points instead of directly providing application points on the work W, a desired number of application points may be secured even on a small work W. In addition, a thin work W is prevented from getting damaged since the work W does not directly receive the compression force. Moreover, particularly when the application points are provided to the jig 160 instead of directly providing the work W with application points, it becomes easy to apply the tensile load to the work W without damaging the work W. The jig 160 elastically deforms with the work W instead of controlling the work W's contact pressure only by plural point loads, and maintains the uniformity of the contact pressure distribution.

Preferably, the controller 170 deforms the jig 160 in stages. In particular, if a large load is applied to the jig suddenly, deforms the jig 160, and the work contacts the polishing surface, a polished surface would damage the polishing surface 111 when the polished surface $W_1$ is a curved surface.

The polishing process is classified in accordance with the monitoring method of the processing amount into a non-external monitoring and an external monitoring. While FIG. 20 describes both the non-external monitoring and external monitoring for convenience, either the step 1050 or the step 1050A actually follows the step 1040.

In the polishing process 1050 or 1050A, as shown in FIGS. 24A and 24B, in accordance with the polishing start command, the controller 170 controls the power supplied to the motor 112, and rotates the motor 112 at a predetermined number of revolutions. Next, the controller 170 opens a valve connected to a predetermined storage tank designated by a user via the input apparatus (not shown), and supplies the predetermined slurry S to the slurry supply pump 120. A motor (not shown) restricts positions of and rotates the processing head 150A, the processing base 290, and the correction ring 158A. The decentering amount adjusting screw 295*a* changes a (polishing) position of a polishing locus P shown in FIG. 24A by offsetting a center of the correction ring 158A from the center of the work W. This configuration eliminates a decrease of the slurry S at that position and a dent of the polishing surface 111 on the locus P, and maintains highly precise processing using the entire polishing surface 111. This is because if the polishing position does not change, the polishing may form, for example, convoluted lines on a surface of the work W. However, the changes of the polishing positions remove the lines, and improve the surface precision. This embodiment sets the decentering amount to about 10 mm. As shown in FIG. 24B, it is preferable to linearly swing the correction ring 158A in the polishing process.

In the non-external monitoring, the jig 160B is detached from the lapping machine 110 for every 20 minutes or so, and the shape of the work W is measured (step 1060), and the processing amount is monitored (step 1070). When the processing amount reaches the target processing amount, a particle diameter of the slurry S is replaced with a finer one for finishing process. This embodiment replaces the slurry's particle diameter from 1 μm to 1/10 μm, for example, by replacing a lapping machine that uses the slurry with a particle diameter of 1 μm with a lapping machine that uses the slurry with a particle diameter of 1/10 μm. In addition, this embodiment switches a bite nose radius and angle as a facing condition, for example, from 0.5 mm to 0.3 mm and 90° to 60°. The facing is a preliminary process conducted prior to lapping, compresses the cutting tool against the polishing surface 111, and forms grooves from flow remnants generated during the polishing time. Switches of the cutting tool nose radius and angle correspond to changes of the groove area and intervals. The present invention may change the cutting tool nose radius is not limited to values in this embodiment.

On the other hand, the external monitoring enables the processing amount to be monitored during the polishing process 1050A (steps 1052 and 1054), and does not require the work shape measuring process 1060. When the processing amount reaches the target processing amount, the external monitoring is similar to the non-external monitoring.

In monitoring the processing amount, the controller 170 controls the processing arm 130, moves the work W to the shape measuring apparatus 140, and measures the current shape of the work W via the measuring head 142. The polishing process polishes the work W, and drops the weight 210 by the compression force. As described above, the shaft 220 can freely move in the vertical direction along the linear bush 292. The measuring system 300 measures the processing amount. The shape measuring apparatus 140 sends the measured current shape to the polishing amount operating unit 172 of the load indicated value operating unit 171 in the controller 170, as shown in FIG. 11.

The polishing amount operating unit 172 receives the target shape stored in the database 176 and the current shape from the shape measuring apparatus 140, and outputs the necessary polishing amount distribution from a difference. The relative speed operating unit 173 receives, from the controller 170, the rotating speed of the lapping machine 110 and the work W's rotating speed by the processing arm 130. The contact pressure operating unit 174 receives the polishing amount distribution and the relative speed distribution from the polishing amount operating unit 172 and the relative speed operating part 173, and outputs the necessary contact pressure distribution from the Preston's relational equation.

The load operating unit 175 receives a necessary contact pressure distribution from the contact pressure operating unit 174, and outputs the load indicated value applied by the actuator 152 based on the deformation amount due to the basic load value of the work obtained from the database 178 and the backward calculation of the Hertz's contact equation. Based on a result of the obtained load indicated value, the controller 170 controls the load applied by the actuator 152. The adjusted load is the load applied in addition to the weight 210, but the variable load may be zero. As a result, the work W can be processed into a target shape. The processing amount is, for example, about 20 μm.

The work release process 1080 removes the finished work W from the jig 160B as shown in FIG. 25. As a premise, the processing head 150 has been removed from the processing base 290. This embodiment uses the wax as the adhesive and releases the work W through heating. After the work W is released, the local fine correction to the shape of the work W by the laser process follows (for example, through the bending process) (step 1100).

Thus, the instant embodiment provides a processing method and apparatus that controls the polishing amount of the work's polished surface $W_1$, which can secure a high shape approximation precision with a small number of application points, and mitigates the local pressure by the point load, by arranging the processing jig 160B that has a guide mechanism into an arbitrary deformation between the actuator 152 and the work W, by providing the application points on the jig 160B rather than directly providing them on the work W, by applying the load to these points, by polishing the work while the processing jig elastically deforms with the work. This embodiment does not use machining of metals that causes a trace of tool, and can form a free-form surface on the work with high precision. No hand lap etc. is needed, which are needed for a removal of a trace of tool, and therefore the once obtained form accuracy. is not decreased [please check to see if this is the proper correction]

Thus, the present invention can provide a processing method and apparatus that can form a complicate shape on a work with high precision.

What is claimed is:

1. A processing method, comprising:

elastically deforming a jig together with a work, the jig having been mounted on the work;

compressing the work against a polishing surface; and moving the work and the polishing surface relative to each other, wherein:

said elastically deforming includes controlling a load applied to the jig at a predetermined position for an elastic deformation, by assuming that there is a linear relationship between the load and a deformation amount of the work associated with the load; and said controlling the load includes:

calculating a necessary polishing amount distribution based on a difference between a current shape of the work and a target shape of the work;

calculating positional information of the work and a relative speed distribution between the work and the polishing surface; and calculating the load based on the polishing amount distribution and the relative speed distribution.

2. A processing apparatus that polishes a work into a predetermined shape by compressing the work against a polishing surface, and by moving the work and the polishing surface relative to each other, said processing apparatus comprising:

an actuator that applies a load to a predetermined position of a jig that has been mounted on a work, and elastically deforms the jig together with the work;

a controller that controls a load applied to the jig at a predetermined position for an elastic deformation, by assuming that there is a linear relationship between the load and a deformation amount of the work associated with the load; and a measuring part that measures a current shape of the work, wherein said controller includes:

a first polishing amount operating unit that calculates a necessary polishing amount distribution based on a difference between a current shape of the work and a target shape of the work;

a second operating unit that calculates a relative speed distribution based on positional information of the work and a rotating speed of the polishing speed;

a third operating unit that calculates a contact pressure distribution of the work against the polishing surface based on the necessary polishing amount distribution and the relative speed distribution; a fourth operating unit that calculates the load necessary for the contact pressure distribution.

3. A processing apparatus that polishes a work into a predetermined shape by compressing the work against a polishing surface, and by moving the work and the polishing surface relative to each other, said processing apparatus comprising;

an actuator that applies a load to a predetermined position of a jig that has been mounted on a work, and elastically deforms the jig together with the work;

a controller that controls a load applied to the jig at a predetermined position for an elastic deformation, by approximating with an arc a deformation amount of the work associated with the load;

a measuring part that measures a current shape of the work, wherein said controller includes:

a first polishing amount operating unit that calculates a necessary polishing amount distribution based on a difference between a current shape of the work and a target shape of the work;

a second operating unit that calculates a relative speed distribution based on positional information of the work and a rotating speed of the polishing speed;

a third operating unit that calculates a contact pressure distribution of the work against the polishing surface based on the necessary polishing amount distribution and the relative speed distribution; and a fourth operating unit that calculates the load necessary for the contact pressure distribution.

4. A processing apparatus that polishes a work into a predetermined shape by compressing the work against a polishing surface, and by moving the work and the polishing surface relative to each other, said processing apparatus comprising:

an actuator that applies a load to a predetermined position of the jig that has been mounted on a work, and elastically deforms the jig together with the work, wherein the jig includes:

a mounting part that mounts the work and forms an arbitrarily curved surface, a rotating lever part that rotates around a rotating center when an external load is applied, and elastically deforms said mounting part, and a fixing part that does not deform even when the external load is applied to said rotating lever; and the processing apparatus, further comprises:

a processing head that mounts the jig and has the actuator;

a processing base that supports said processing head; and a positioning mechanism to position the work on the polishing surface, the positioning mechanism comprising:

plural shafts provided to one of said processing head and said processing base, and a linear bush, provided to the other of said processing head and said processing base, which allows a movement along a longitudinal direction of the shaft.

5. A processing apparatus according to claim 4, further comprising a measuring system that measures a processing amount of the work, wherein said measuring system includes:

a measuring part that measures a processing amount of an object to be measured, which is provided on the processing head; and a reference measuring part that outputs a reference value to be compared with a measurement result measured by the measuring part.

6. A processing apparatus that polishes a work into a predetermined shape by compressing the work against a polishing surface, and by moving the work and the polishing surface relative to each other, said processing apparatus comprising:

an actuator that applies a load to a predetermined position of a jig that has been mounted on a work, and elastically deforms the jig together with the work, wherein the jig includes:

a mounting part that mounts the work and forms an arbitrarily curved surface, a rotating lever part tat rotates around a rotating center when an external load is applied, and elastically deforms said mounting part, a fixing part that does not deform even when the external load applied to said rotating lever, a processing head that mounts the jig and has the actuator, a processing base that supports said processing head, a positioning mechanism for positioning the work on the polishing surface, the positioning mechanism includes a pivot provided to one of said processing head and said processing base, and the other of said processing head and said processing base contacts the pivot at one point, a measuring system that measures a processing amount of the work, the measuring system comprising a measuring part that measures a processing amount of an object to be measured, which is provided on the processing head, and a reference measuring part that outputs a reference value to compared with a measurement result measured by the measuring part.

* * * * *

UNITED STATES PATENT AND TRADEMARK OFFICE

CERTIFICATE OF CORRECTION

PATENT NO. : 7,534,159 B2
APPLICATION NO. : 11/094659
DATED : May 19, 2009
INVENTOR(S) : Michinao Nomura et al.

It is certified that error appears in the above-identified patent and that said Letters Patent is hereby corrected as shown below:

Column 20, Line 28, change “tat” to --that--.

Column 20, Line 48, after “to” insert --be--.

Signed and Sealed this

Sixth Day of October, 2009

David J. Kappos

David J. Kappos
*Director of the United States Patent and Trademark Office*